US009879878B2

(12) United States Patent
Lee et al.

(10) Patent No.: US 9,879,878 B2
(45) Date of Patent: Jan. 30, 2018

(54) DEHUMIDIFIER

(71) Applicant: LG ELECTRONICS INC., Seoul (KR)

(72) Inventors: Jongsu Lee, Seoul (KR); Kunyoung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 239 days.

(21) Appl. No.: 14/679,272

(22) Filed: Apr. 6, 2015

(65) Prior Publication Data

US 2015/0285531 A1 Oct. 8, 2015

(30) Foreign Application Priority Data

Apr. 5, 2014 (KR) ..... 10-2014-0040847

(51) Int. Cl.

| | |
|---|---|
| ***F25D 23/00*** | (2006.01) |
| ***F25D 11/02*** | (2006.01) |
| ***F25D 17/06*** | (2006.01) |
| ***F25D 21/00*** | (2006.01) |
| ***F24F 13/20*** | (2006.01) |
| ***B65D 25/30*** | (2006.01) |
| ***F24F 3/14*** | (2006.01) |
| ***F24F 1/02*** | (2011.01) |

(52) U.S. Cl.

CPC ..... *F24F 13/20* (2013.01); *B65D 25/30* (2013.01); *F24F 1/025* (2013.01); *F24F 3/14* (2013.01); *F24F 3/1405* (2013.01); *B65D 2525/283* (2013.01); *F24F 2003/144* (2013.01); *F24F 2003/1446* (2013.01)

(58) Field of Classification Search

CPC ..... B65D 25/30; B65D 25/28; B65D 25/282; B65D 25/2826; B65D 25/2832; B65D 25/2867; B65D 25/2882; B65D 25/2885; B65D 25/2888; B65D 25/2894; B65D 25/2897; B65D 25/283; F24F 3/14; F24F 3/1405; F24F 1/025; F24F 1/04; F24F 13/20; F24F 2003/144; F24F 2003/1446; F24F 2221/12

USPC ..... 62/271, 443, 93, 272

See application file for complete search history.

(56) References Cited

U.S. PATENT DOCUMENTS 4,967,569 A 11/1990 Machen et al.
5,480,588 A * 1/1996 Tomasiak ..... F24F 6/043 261/104
5,901,565 A 5/1999 Morton, Jr.
(Continued)

FOREIGN PATENT DOCUMENTS

CH 698538 B1 * 8/2009 ..... F24F 13/20
CN 1428561 7/2003
(Continued)

OTHER PUBLICATIONS

Machine translation of CH 698538.*
(Continued)

*Primary Examiner* — Joseph Trpisovsky
(74) *Attorney, Agent, or Firm* — Ked & Associates, LLP

(57) ABSTRACT

A dehumidifier has a handle that is recessed inward from a top surface of a main body to open both side surfaces thereof and is disposed to stably move the main body of the dehumidifier without deteriorating an outer appearance of the dehumidifier.

6 Claims, 24 Drawing Sheets

(56) References Cited

U.S. PATENT DOCUMENTS

| | | | | |
|---|---|---|---|---|
| 6,335,517 | B1 * | 1/2002 | Chauviaux | B24B 49/105 219/628 |
| 2004/0144117 | A1 * | 7/2004 | Kim | F24F 1/027 62/262 |
| 2006/0278084 | A1 * | 12/2006 | Kim | B01D 53/261 96/140 |

FOREIGN PATENT DOCUMENTS

| | | | |
|---|---|---|---|
| CN | 2903763 | | 5/2007 |
| CN | 101178214 | | 5/2008 |
| CN | 202040906 | | 11/2011 |
| EP | 0 716 275 | A2 | 6/1996 |
| EP | 1 876 396 | A2 | 1/2008 |
| JP | H 05-3815 | | 1/1993 |
| KR | 10-2000-0057823 | A | 9/2000 |
| KR | 10-2005-0083417 | A | 8/2005 |
| KR | 10-2006-0129677 | A | 12/2006 |
| KR | 10-2013-0055369 | A | 5/2013 |
| KR | 10-2013-0138478 | A | 12/2013 |
| WO | WO 93/14353 | A1 | 7/1993 |

OTHER PUBLICATIONS

European Search Report dated Oct. 14, 2015 issued in Application No. 15162358.4.

Korean Notice of Allowance dated Dec. 17, 2015 issued in Application No. 10-2014-0040847.

Korean Office Action issued in Application No. 10-2014-0040847 dated Jun. 5, 2015.

Chinese Office Action (with Full English Translation) dated Apr. 26, 2017 issued in Application No. 201510160826.9.

* cited by examiner

DEHUMIDIFIER

CROSS-REFERENCE TO RELATED APPLICATION

The application claims priority under 35 U.S.C. § 119 and 35 U.S.C. § 365 to Korean Patent Application No. 10-2014-0040847 filed Apr. 5, 2014, whose entire disclosure is hereby incorporated by reference.

BACKGROUND

1. Field

The present disclosure relates to a dehumidifier.

2. Background

A dehumidifier is an apparatus which suctions wet humid air within an indoor space into a case and allow the air to pass through a heat exchanger including a condenser and an evaporator, thereby reducing the humidity. The dehumidified air may be discharged again into the indoor space to reduce the humidity within the indoor unit. In recent years, large-scale and multifunctional dehumidifiers are being released to improve dehumidifying performance and user's convenience. Thus, high-capacity and large-scale humidifiers are greatly to be preferred.

A dehumidifier may absorb heat from surrounding air by evaporating a liquid refrigerant in the evaporator. The evaporator may decrease in temperature while the refrigerant is evaporated, and thus, the air passing through the evaporator may also decrease in temperature. Since the surrounding air of the evaporator decreases in temperature, moisture contained in the air may be condensed to form dew on a surface of the evaporator. The dehumidified air may be discharged into the indoor space to reduce the humidity within the indoor space.

A dehumidifier in which a lower portion of an evaporator has a basket shape to collect and store condensed water is disclosed in Korean Patent Publication No. 10-2005-0083417. In the dehumidifier having the above-described structure, if a preset amount or more of water is collected into the basket, a user may withdraw the basket to discard water within the basket and then mount the basket again.

A structure of a dehumidifier in which a water tank is mounted on a recessed water tank mounting part of a main body, and the water is withdrawn in a state where the water tank rotates by manipulation of a water tank handle disposed on a front surface of the water tank is disclosed in Korean Patent Publication No. 10-2013-0138478.

However, in the above-described prior arts, a handle for manipulating movement of the main body of the dehumidifier or a component similar to the handle is not provided. Also, in case of the large-scale dehumidifier, if the dehumidifier forcibly moves, the dehumidifier may fall down due to a high height of the dehumidifier to threaten the security of the user or damage the dehumidifier. In case of the large-scale dehumidifier, since the dehumidifier is heavy, it may be difficult to move the dehumidifier by only pulling or pushing the main body.

BRIEF DESCRIPTION OF THE DRAWINGS

The embodiments will be described in detail with reference to the following drawings in which like reference numerals refer to like elements wherein.

DETAILED DESCRIPTION

Figure 1:
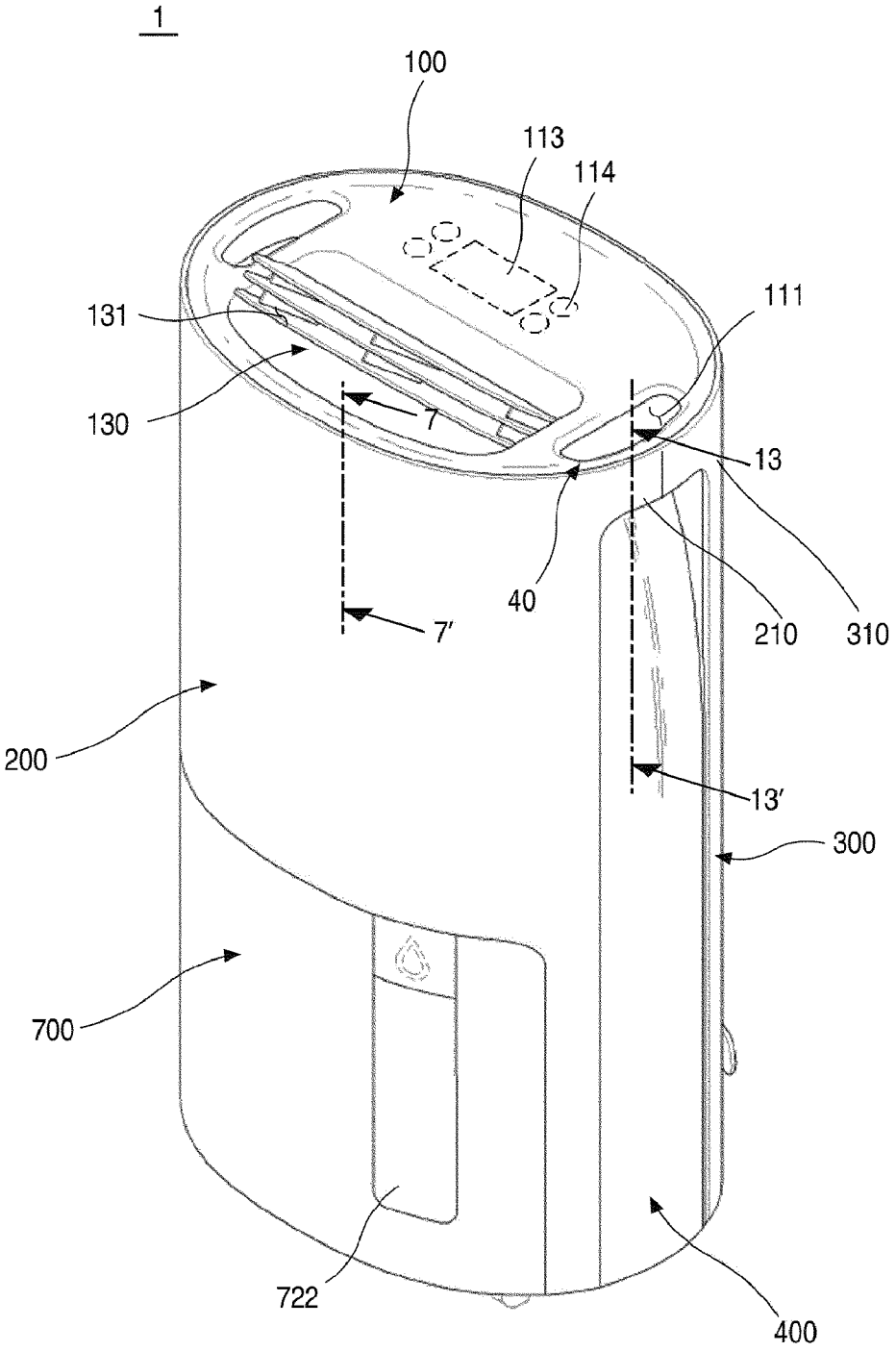
FIG. 1 is a front perspective view of a dehumidifier according to an embodiment.
Figure 2:
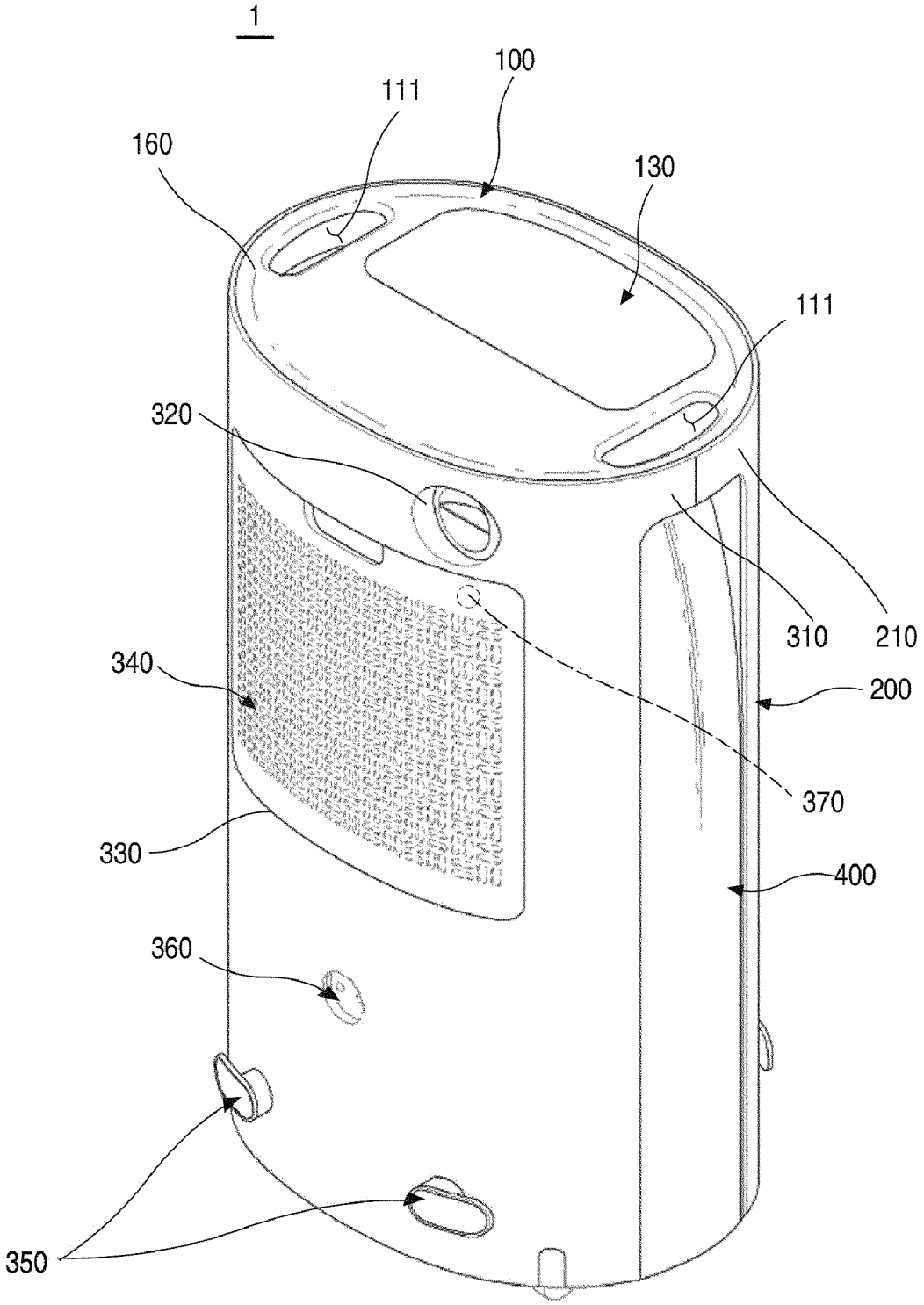
FIG. 2 is a rear perspective view of the dehumidifier.
Figure 3:
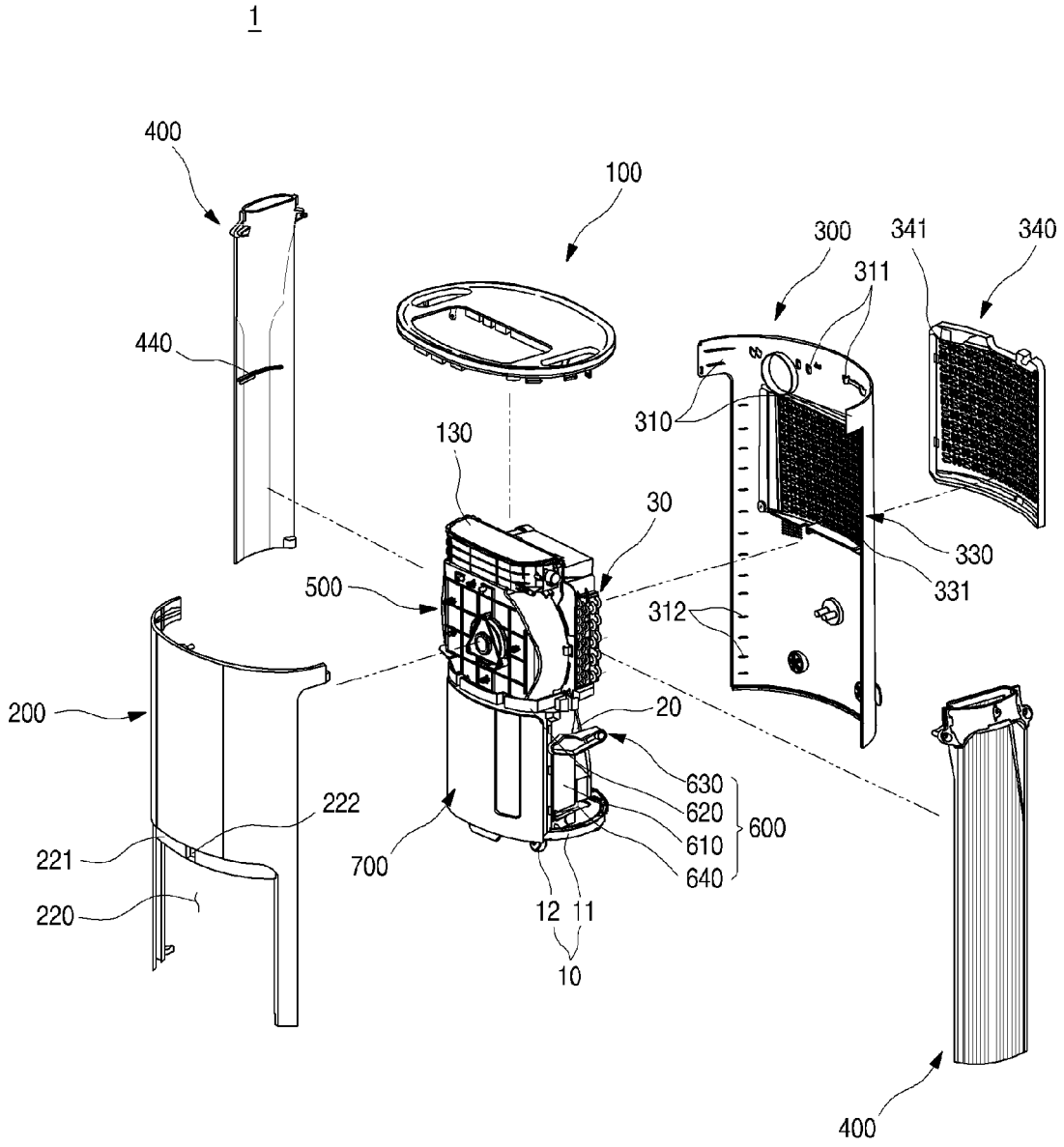
FIG. 3 is an exploded perspective view of the dehumidifier.
Figure 4:
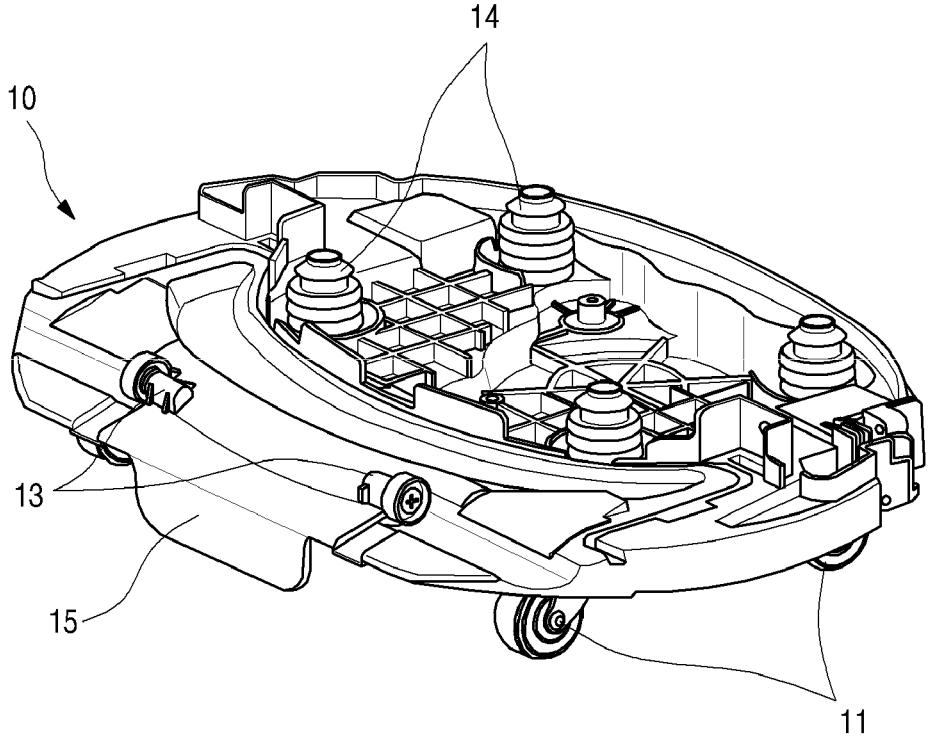
FIG. 4 is a perspective view of a base pan assembly that is one component of the dehumidifier.

FIG. 1 is a front perspective view of a dehumidifier according to an embodiment. FIG. 2 is a rear perspective view of the dehumidifier. FIG. 3 is an exploded perspective view of the dehumidifier. FIG. 4 is a perspective view of a base pan assembly that is one component of the dehumidifier.

Referring to FIGS. 1 to 4, a main body defining a dehumidifier 1 according to an embodiment has a generally circular cross-section when viewed from an upper side and a cylindrical shape having a predetermined height. The dehumidifier 1 may have an outer appearance that is defined by a top cover assembly 100 defining a top surface, a base pan assembly 10 defining a bottom surface, front and rear cases 200 and 300 defining front and rear surfaces, and a side deco 400 defining a portion of each of both side surfaces.

The tap cover assembly 100 may define a top surface of the dehumidifier 1 and has an oval shape. A handle hole 111 into which a hand of a user is inserted to grasp the dehumidifier 1 when the dehumidifier 1 moves may be defined in each of both sides of the top cover assembly 100.

A louver 130 is disposed in a front portion of the top cover assembly 100. The louver 130 has a plurality of discharge holes 131 through which air dehumidified within the dehumidifier 1 is discharged. The louver 130 is rotatably mounted on the top cover assembly 100. The louver 130 may rotate to expose the discharge holes 131 thereof when the dehumidifier 1 operates. On the other hand, when the dehumidifier 1 does not operate, the louver 130 may rotate to close or cover the discharge holes 131. When dehumidifier 1 does not operate, the louver 130 may form the same plane as the top cover assembly 100 to define the outer appearance of the top surface of the dehumidifier 1. The louver 130 may rotate by a motor 132. When the dehumidifier 1 operates, the louver 130 may automatically rotate to open the discharge holes 131, thereby adjusting a discharge direction of the dehumidified air.

A manipulation part 114 is disposed on the top cover assembly 100. The manipulation part 114 may be manipulated by the user to manipulate the dehumidifier 1. The manipulation part 114 may be provided in a rear space of the louver 130. Also, the manipulation part 114 may be manipulated by the user and confirmed through the top surface of the top cover assembly 100. The manipulation part 114 may include a capacitive-type touch sensor, a button, or a switch. Also, a display part 113 for displaying an operation state of the dehumidifier 1 may be further disposed on one side adjacent to the manipulation part 151.

The base pan assembly 10 includes a base pan 11 defining the bottom surface of the dehumidifier 1 and a wheel 12 mounted on the base pan 11. The base pan 11 may provide a surface on which a compressor 20 that is main component of the dehumidifier 1 and a plurality of components are disposed. For this, a plurality of reinforcing ribs that cross each other are disposed on the base pan 11 to prevent the base pan 11 from being deformed or damaged even though the plurality of components are mounted on the base pan 11. The whole shape of the base pan 11 may have an oval shape to correspond to that of the top cover assembly 100.

A base roller 13 is disposed on a front end of a top surface of the base pan 11. The base roller 13 may contact a bottom surface of a tank drawer 710 and then rolled when the tank drawer 710 into which a water tank 800 is accommodated is withdrawn forward. When the tank drawer 710 is completely withdrawn, a weight center of the tank drawer 710 is defined at a relatively front side when compared to the base roller 13. Thus, the tank drawer 710 may be tilted.

A buffer member 14 supporting the compressor 20 is disposed on the top surface of the base pan 11. The buffer member 14 may be disposed on a portion on which the compressor 20 is seated to prevent vibration and noise generated when the compressor 20 is driven from occurring.

A wheel 12 may be disposed on a bottom surface of the base pan 11 to easily move the dehumidifier 1. Particularly, when the user grasps the handle 40 of the dehumidifier 1 to move the dehumidifier 1, the wheel 12 may be shaft-coupled to the bottom surface of the base pan 11 to rotate in a moving direction so that the user easily pushes or pulls the dehumidifier 1.

A support 15 is disposed on a front end of a bottom surface of the base pan 11. The support 15 extends downward. An extension end of the support 15 may be disposed above a lower end of the wheel 12. The support 15 may prevent the dehumidifier 1 from being tilted or inverted when the water tank assembly 700 is withdrawn, or the dehumidifier 1 moves. The support 15 may be disposed at a front side of the withdrawal direction of the water tank assembly 700 to contact the ground when the weight center moves due to the withdrawal of the water tank assembly 700, thereby preventing the dehumidifier 1 from being tilted or inverted.

The front case 200 and the rear case 300 define the front and rear outer appearances of the dehumidifier 1. The front case 200 and the rear case 300 may be formed of plate-shaped materials and coupled to the bottom surfaces of the tap cover assembly 100 and the base fan 11, respectively. Thus, the front case 200 and the rear case 300 may have curvatures corresponding to circumferences of the top cover assembly 100 and the base pan 11, respectively.

A front extension part 210 extending backward is disposed on each of both left and right sides of an upper end of the front case 200. The front extension part 210 may contact a rear extension part 310 of the rear case 300 to connect the front case 200 to the rear case 300. The front extension part 210 is coupled along a circumference of the top cover assembly 100.

A tank mounting part 220 on which the water tank assembly 700 is disposed is disposed below the front case 200. The tank mounting part 220 may be opened in a shape corresponding to a shape of a tank drawer 710 constituting the water tank assembly 700. A stepped part 221 having a stepped portion extends downward from an upper end of the tank mounting part 220. When the tank drawer 710 is closed, the tank mounting part 220 may contact a back surface of the tank drawer 710. Also, a latch hole 222 through which a locker 724 protruding from the tank drawer 710 is inserted or withdrawn is defined in a center of the stepped part 221.

The rear case 300 may define a rear outer appearance of the dehumidifier 1 and have a shape corresponding to that of the front case 200. A rear extension part 310 may be disposed on each of both left and right ends of an upper portion of the rear case 300 and coupled to the front extension part 210.

An accessory hole 320 is defined in an upper portion of the rear case 300. The accessory hole 320 may be a hole through which an accessory connection part that will be described later passes. The accessory hole 320 may be opened in a shape corresponding to that through which the accessory connection part 570 passes to protrude to the outside.

A suction grill part 330 is disposed below the accessory hole 320. The suction grill part 330 has a rectangular shape that is recessed inward. The suction grill part 330 has a shape corresponding to that of a heat exchange module 30 that will be described later. The suction grill part 330 has a plurality of suction holes 331 so that external air is introduced into the dehumidifier 1.

A grill cover or filter 340 is mounted on a recessed outer portion of the suction grill part 330. The grill cover 340 covers a recessed space of the suction grill part 330 and forms the same line as an outer surface of the rear case 330. A plurality of holes may be defined in the grill cover 340 so that air flows through the suction grill part 330.

The grill cover 340 is detachably disposed on the suction grill part 330. A filter assembly 341 may be mounted between the suction grill part 330 and the grill cover 340.

The filter assembly 341 may filter foreign substances of the air introduced through the suction grill part 330. The filter assembly 341 may be fixed to the suction grill part 330 or fixed to a back surface of the filter assembly 341 as illustrated in FIG. 3.

A cord fixing hole 360 and a cord holder 350 may be disposed below the suction grill part 330. The cord holder 350 may be provided in a pair in each of both left and right sides. The cord holder 350 protrudes backward from the rear case 300 so that a power line for supplying a power to the dehumidifier 1 is wound around the pair of cord holder 350 and stored. The protruding end of the cord holder extends outward.

The cord holder 360 is disposed above the cord holder 350. The cord holder 360 may be disposed at a central portion and recessed in a space corresponding to a socket so that a plug of an end of the power line is inserted. The power line may be wound around the cord holder 350, and then the plug is inserted into the cord fixing hole 360 to effectively fix and store the power line.

The top cover assembly 100 and the base pan 11 may be fixedly mounted on upper and lower ends of the front case 200 and the rear case 300, respectively. The side deco 400 may be mounted between the front case 200 and the rear case 300 to define the whole outer appearance of the dehumidifier 1.

A housing assembly 500 including a blowing fan 540 and the motor 530 and the heat exchange module 30 heat-exchanged with the suction air may be disposed in an upper portion inside the front case 200 and the rear case 300. Electronic components including a frame 600 supporting the housing assembly 500 and the heat exchange module 30, the water tank assembly 700 for collecting condensed water generated in the heat exchange module 30, and a compressor connected to the heat exchange module 30 to compress a refrigerant may be disposed in a lower portion inside the front case 200 and the rear case 300.

The frame 600 may be mounted to a center of the base pan 11. The frame 600 includes a vertical part 610 extending vertically and a horizontal part 620 extending horizontally from an upper end of the vertical part 610.

The vertical part 610 may partition a lower space of the dehumidifier 1 into front and rear spaces to define the front space in which the water tank assembly 700 is mounted and the rear space in which the electronic components including the compressor 20 are mounted. A main guide 630 and a sub guide are disposed on both left and right sides of the vertical part 610 so that the tank drawer 710 is slidably inserted or withdrawn.

The horizontal part 620 may partition the inner space of the dehumidifier 1 into upper and lower spaces so that the housing assembly 500 and the heat exchange module 30 are seated. A passage for guiding the condensed water generated in the heat exchange module 30 to the water tank 800 is defined in the horizontal part 620.

Figure 5:
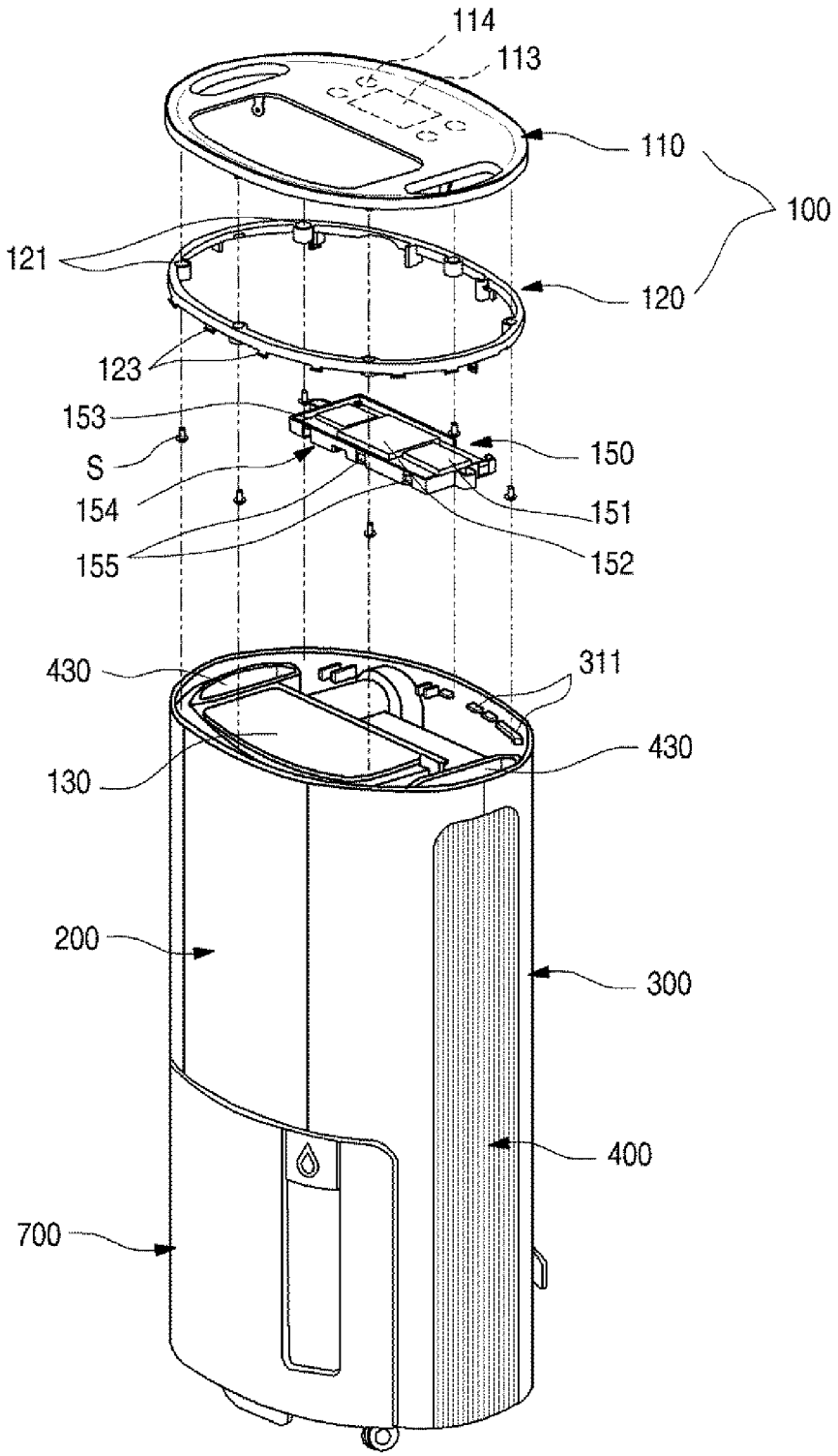
FIG. 5 is an exploded perspective view illustrating a coupling structure between a top cover assembly that is one component of the dehumidifier and a main body.
Figure 6:
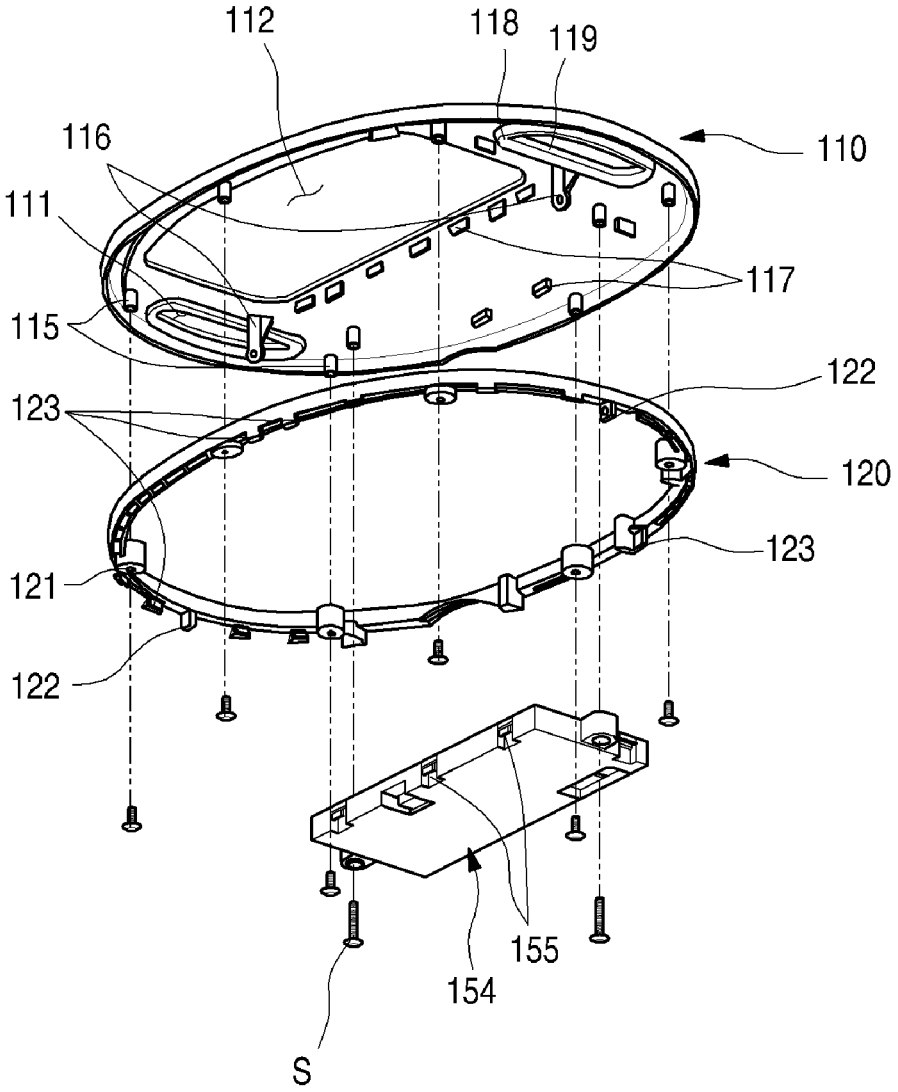
FIG. 6 is an exploded perspective view of the top cover assembly.
Figure 7:
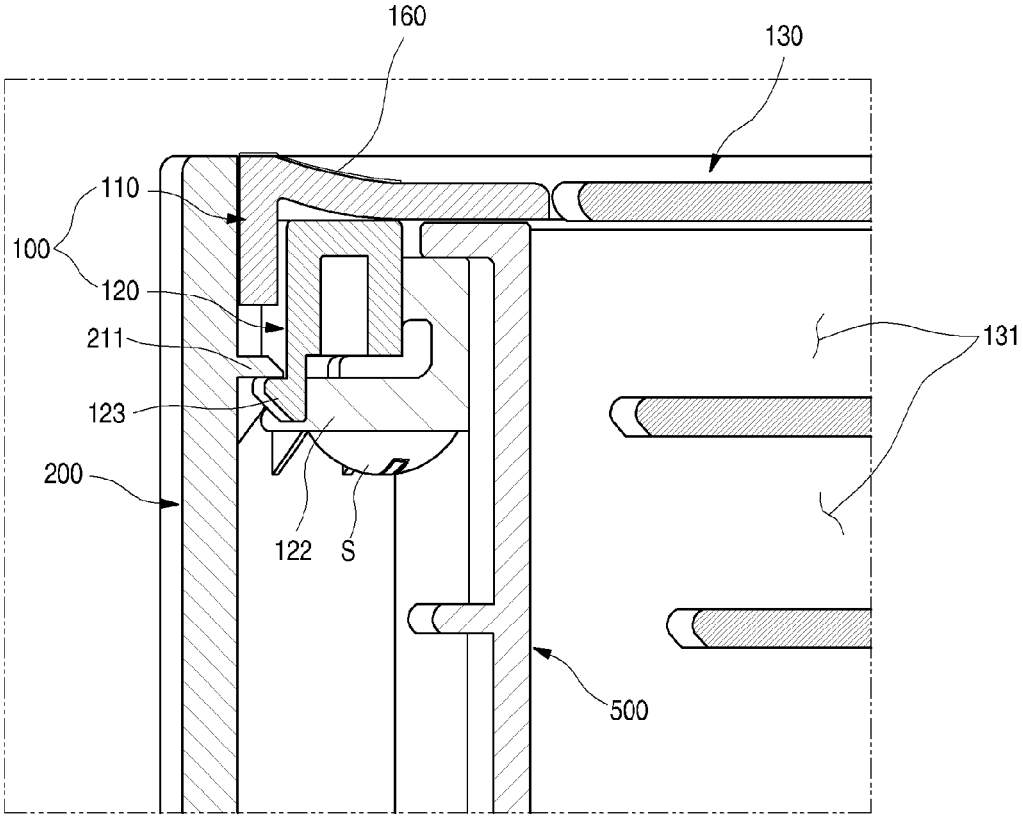
FIG. 7 is a cross-sectional view taken along line 7-7' of FIG. 1.

A specific shape of the frame 600 will be described below in more detail. FIG. 5 is an exploded perspective view illustrating a coupling structure between a top cover assembly that is one component of the dehumidifier and a main body. FIG. 6 is an exploded perspective view of the top cover assembly. FIG. 7 is a sectional view taken along line 7-7' of FIG. 1. The top cover assembly 100 will be described in more detail with reference to referring to FIGS. 5 to 7. The top cover assembly 100 may include a cover plate 110 and a cover frame 120.

The cover plate 110 defines an outer appearance of the top surface of the dehumidifier 1. The cover plate 110 may have a plate shape and an oval shape corresponding to the whole shape of the top surface of the dehumidifier 1.

A handle hole 111 in which a handle 40 of the dehumidifier 1 is formed is punched in each of both left and right side of the cover plate 110. The handle hole 111 is configured so that the hand of the user is inserted to grasp both sides of the dehumidifier 1. The handle hole 111 may have a size corresponding to that of an opening 430 of the side deco 400.

A louver mounting hole 112 in which the louver 130 is disposed is defined in the cover plate 110. The louver mounting hole 112 may have a size and shape corresponding to those of the louver 130 in the state where the louver 130 is closed. A top surface of the louver 130 may cover the louver mounting hole 112 in the state where the louver 130 is closed to form the same plane as the cover plate 110. When the louver 130 is opened, the louver mounting hole 112 may also be opened.

A display part window 113 is disposed at a rear side of the louver mounting hole 112. The display part window 113 may allow the display unit 152 to be exposed. The display part window 113 may be opened in a shape corresponding to the display unit 152 or be formed of a transparent material to cover the opened portion. Also, a printing part 114 for informing a position of the manipulation part 151 may be further disposed on the cover plate 110 adjacent to the display part window 113. Thus, the printing part 114 may be touched to manipulate the manipulation part. Cover coupling parts 115 may be disposed to be spaced a predetermined distance from each other along a circumference of a bottom surface of the cover plate 110. The cover coupling part 115 may be a portion to which a screw S passing through the cover frame 120 is coupled. The cover plate 110 may be coupled to the cover frame 120 through the cover coupling part 115.

A cover fixing part 116 coupled to the housing assembly 500 by using the screw S extends downward from each of both sides of a bottom surface of the cover plate 110. The cover fixing part 116 may contact one side of a control box mounting part 580 of the housing cover 520 and be fixed by the screw S to allow the top cover assembly 100 to be fixedly mounted. See FIG. 14, 15

A manipulation unit fixing member or ribs 117 for fixedly mounting a manipulation unit 150 is disposed on the bottom surface of the cover plate 110 corresponding to the manipulation part 151 and the display unit 152. The manipulation unit fixing member 117 has a rib shape. The manipulation unit fixing member 117 may be provided in plurality, and thus the plurality of manipulation unit fixing members 117 may be disposed at a predetermined distance along a circumference of the manipulation unit 150. A hook may be disposed on an end of the manipulation unit fixing member 117 to restrain the circumference of the manipulation unit 150 by the manipulation unit fixing member 117 so that the manipulation unit 150 is fixedly mounted on the back surface of the cover plate 110.

The manipulation unit or control module 150 may include the display unit or display module 152 and the manipulation part or input module 151. A display and a plurality of switches or sensors may be disposed on one PCB 591 to form the display unit 152 and the manipulation part 151 so that the user manipulates an operation of the dehumidifier 1 or informs an operation state of the dehumidifier 1 to the outside. Alternatively, the manipulation unit 150 may be constituted by only the manipulation part 151, and the display unit 152 may be independently provided as a separate part.

The manipulation unit 150 further includes a board case 154 accommodating the PCB 153. A case hook part 155 in which the manipulation unit fixing member 117 is inserted to pass therethrough and is hooked thereto may be further disposed on a circumference of the board case 154.

A handle hole rib 118 extending downward is disposed along a circumference of the handle hole 111. The handle hole rib 118 may have a shape corresponding to an upper end of the side deco 400 so that the handle hole rib 118 and the upper end of the side deco 400 are coupled to each other to match each other. A rib stepped part 119 having a stepped portion may be disposed on the handle hole rib 118 and be coupled to a deco stepped part 431 (see FIG. 12) disposed on the upper end of the side deco 400 to match the deco stepped part 431. Thus, the side deco 400 may be fixed while being maintained in position on the cover plate 110 to form the handle 40.

A circumference 160 is disposed around a top surface of the cover plate 110. The circumference 160 has an upward protruding shape. Also, the inside of the circumference 160 may have a roundly recessed shape. A chrome line may be printed on the circumference 160 of the cover plate 110 as if a separate member formed of a chrome material is coupled to the cover plate 110. For this, the cover plate 110 may be injection-molded by using an in-mold labeling (IML) manner. That is, the cover plate 110 is injection-molded by using a plastic material. Here, a chrome film may be printed on the circumference 160.

The cover plate 110 molded through the above-described manner may be unnecessary to having a coupling structure of a separate component formed of a chrome material. When the cover plate 110 is molded, the cover plate 110 together with the circumference 160 may be molded at the same time.

To mold the cover plate 110 by using the IML injection manner, the cover plate 110 may have to be simplified in structure. For this, it may be necessary to provide a cover frame 120 having a separate coupling structure for coupling the top cover assembly 100 to the front and rear cases 200 and 300.

The top cover assembly 100 may be coupled to the front and rear cases 200 and 300 due to the coupling structure between the cover frame 120 and the cover plate 110. The cover plate 110 may have a simplified structure due to the cover frame 120 coupled to the front and rear cases 200 and 300, and thus, the cover plate 110 may be injection-molded by using the ILM manner.

The cover frame 120 may be mounted on a bottom surface of the cover plate 110 and have a ring shape with a size corresponding to that of the cover plate 110. Frame coupling parts 121 disposed on the bottom surface of the cover plate 110 and spaced a predetermined distance from each other along a circumference of the cover plate 110 are disposed on the cover frame 120.

A screw S for coupling, which is disposed at a position corresponding to each of the cover coupling parts 115, may be coupled to the cover plate 110. Here, the cover coupling part 115 extends downward. The extending cover coupling part 115 may be inserted into the frame coupling part 121. When the screw S is coupled upward from a lower side, the screw S may pass through the frame coupling part 121 and then be coupled to the cover coupling part 115. Thus, the cover frame 120 may be fixed to the cover plate 110.

A deco fixing part 122 extending downward and through which the screw S coupled to the housing assembly 500 passes may be disposed on each of both left and right sides of the cover frame 120. The deco fixing part 122 may be screw-coupled to a handle fixing part 426 of a side deco 400 that will be described below to maintain the fixed state of the top cover assembly 100 and the side deco 400 (see FIG. 12).

A plurality of frame fixing hooks 123 may be disposed along a circumference of the bottom surface of the cover frame 120. The top cover assembly 100 may be hooked with top cover coupling parts 211 disposed on the front case 200 through the frame fixing hooks 123.

The cover frame 120 may be coupled to the front case 200. Since the cover frame 120 is coupled to the cover plate 110, the top cover assembly 100 and the front case 200 may have structures through which the top cover assembly 100 and the front case 200 are coupled and fixed to each other.

The top cover coupling parts to be coupled to the top cover assembly 100 are disposed on an upper portion of a back surface of the front case 200. The top cover coupling parts 211 are disposed above the front case 200 and disposed along a circumference of the top cover assembly. Thus, the top cover coupling parts 211 may be provided in plurality at a predetermined distance and are respectively hooked with the frame fixing hooks 123.

Figure 8:
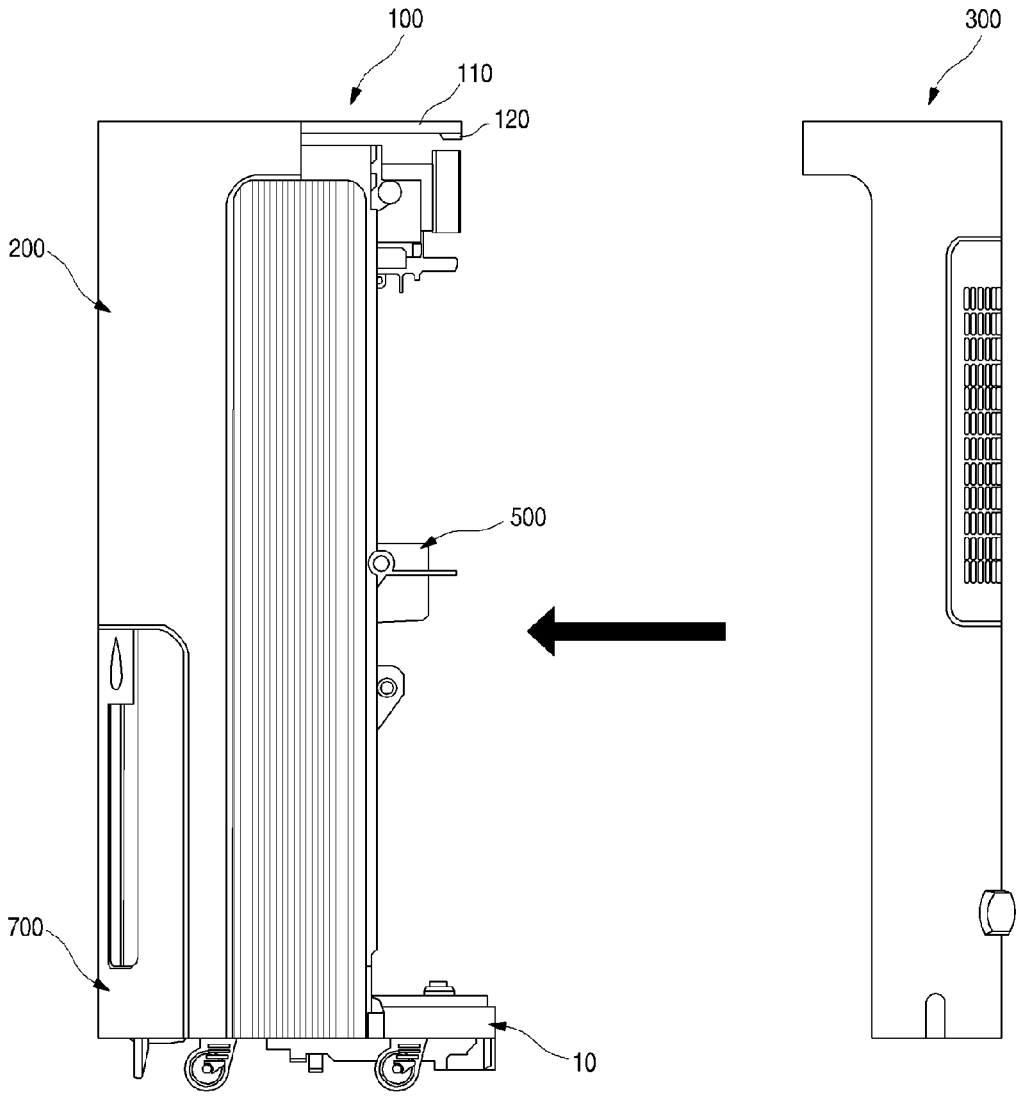
FIG. 8 is an exploded perspective view illustrating coupling of a rear case that is one component of the dehumidifier.
Figure 9:
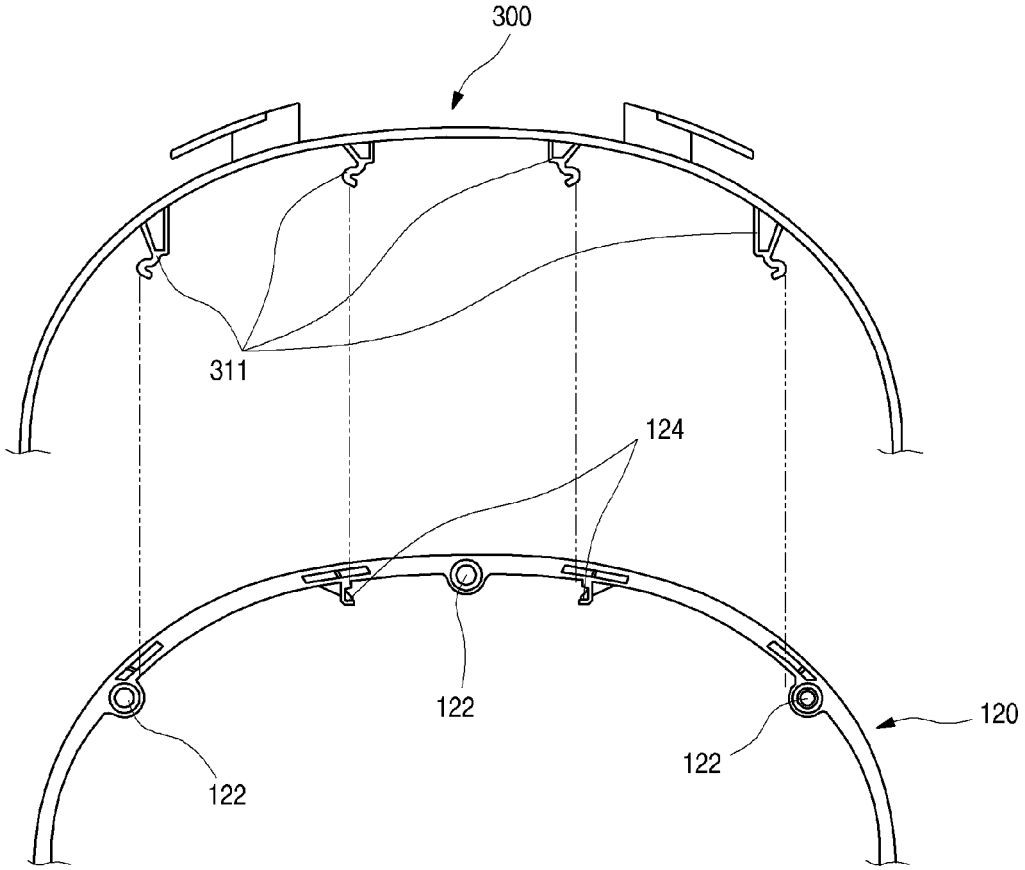
FIG. 9 is a perspective view illustrating a coupling structure between the rear case and a cover frame.
Figure 10:
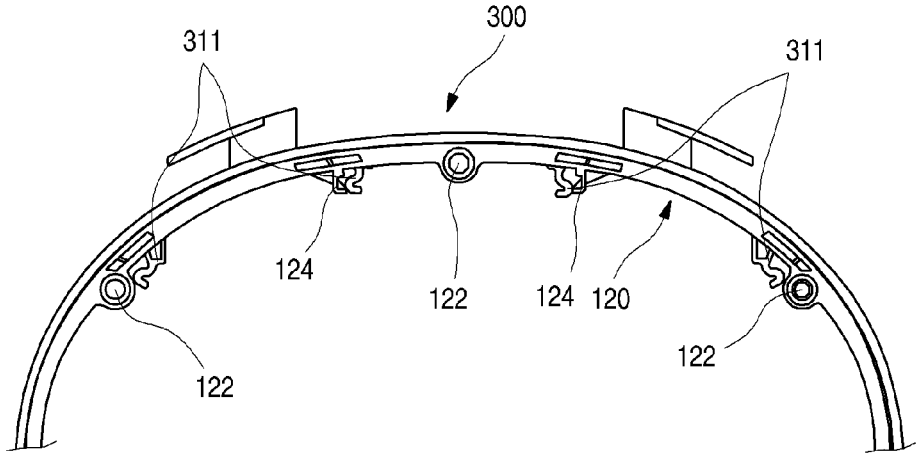
FIG. 10 is a perspective view illustrating a state in which the rear case is coupled to the cover frame.

FIG. 8 is an exploded perspective view illustrating coupling of the rear case that is one component of the dehumidifier. FIG. 9 is a perspective view illustrating a coupling structure between the rear case and the cover frame. FIG. 10 is a perspective view illustrating a state in which the rear case is coupled to the cover frame.

Referring to FIGS. 8 to 10, the rear case 300 may be inserted forward from a rear side and then fixedly mounted in a state where the front case 200 are fixedly mounted on the top cover assembly 100 and the base pan assembly 10, and all of the frame 600, the housing assembly 500, the heat exchange module 30, and the compressor 20 are mounted within the main body of the dehumidifier 1. To fix the rear case 300, a lower end of the rear case 300 is inserted into and fixed to the base pan 10, and an upper portion of the rear case 300 is fixed to an upper portion of the cover frame 120.

For this, a plurality of rear case restriction parts 124, may be disposed on the cover frame 120 contacting the rear case 300. The rear case restriction part 124 extends inward or downward from the cover frame 120 and is hooked with a rear case coupling part disposed on the rear case 300. The rear case restriction part 124 may be provided in plurality and disposed at a position corresponding to the rear case coupling part 311. If necessary, the rear case coupling part 311 may be hooked with the frame fixing part 121.

The rear case coupling part 311 is disposed on a back surface of the rear case 300 and is provided in plurality with a predetermined distance at a height corresponding to that of the cover frame 120. The rear case coupling part 311 may extend forward and have a shape with elasticity so that the rear case coupling part 311 is hooked with the rear case restriction part 124.

The rear case coupling part 311 extends forward as illustrated in FIG. 10. A portion of the rear case coupling part 311, which contacts the rear case restriction part 124 may be bent and thus elastically deformed. Thus, when the rear case 300 is assembled, the rear case 300 may be simply firmly coupled in a press-fit manner without using a separate coupling member such as a screw.

Figure 11:
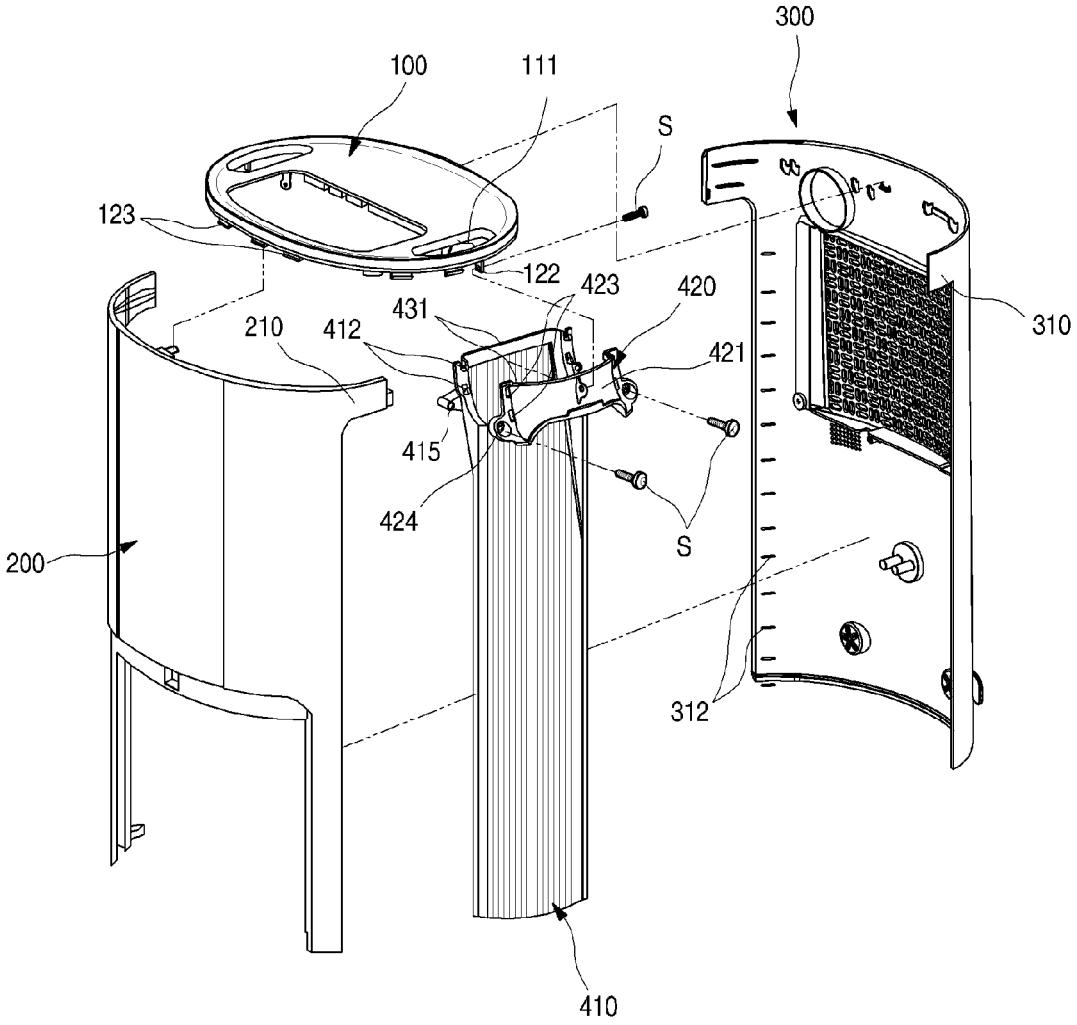
FIG. 11 is an exploded perspective view illustrating a coupling structure of a side deco that is one component of the dehumidifier.
Figure 12:
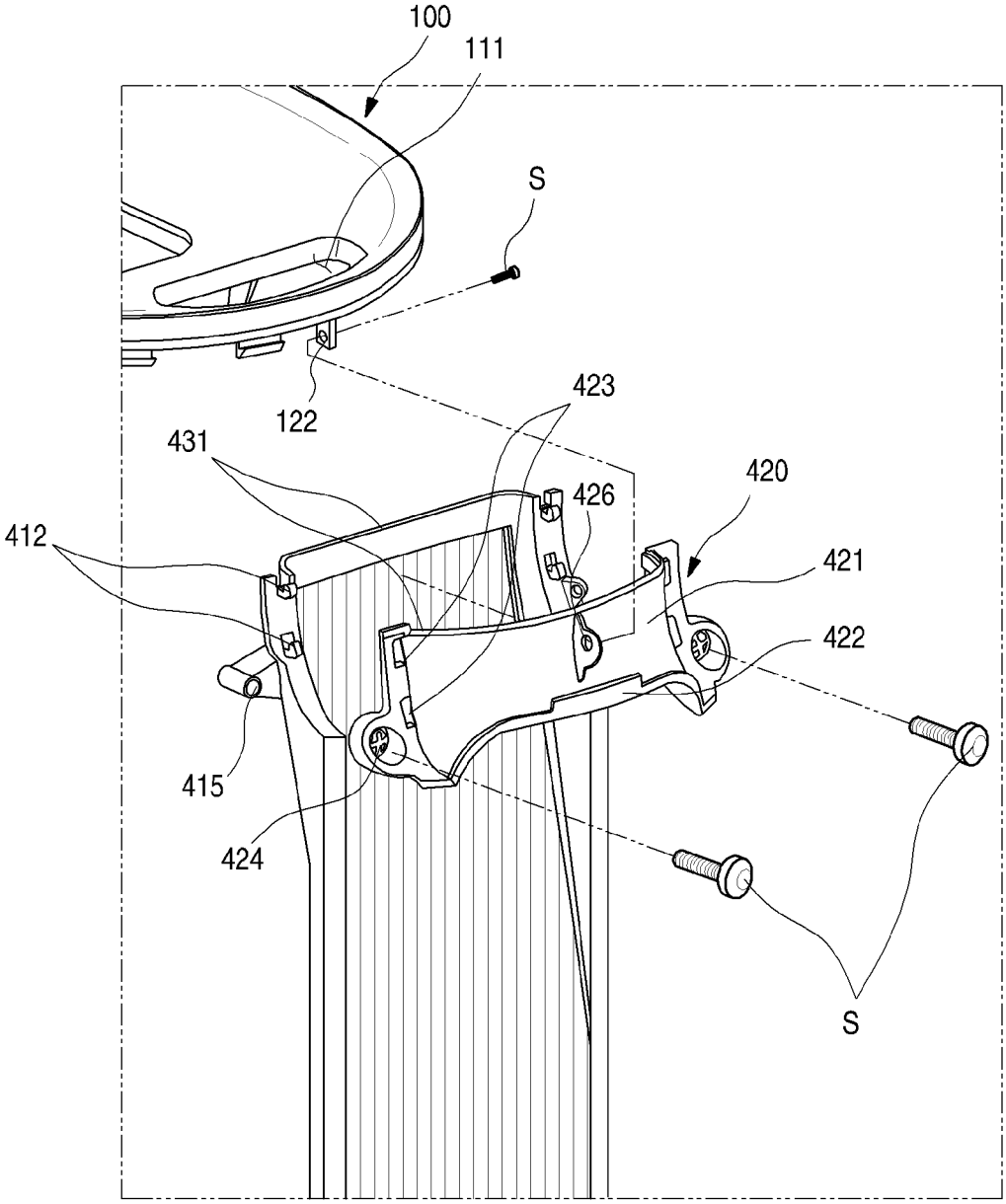
FIG. 12 is an exploded perspective view of the side deco.
Figure 13:
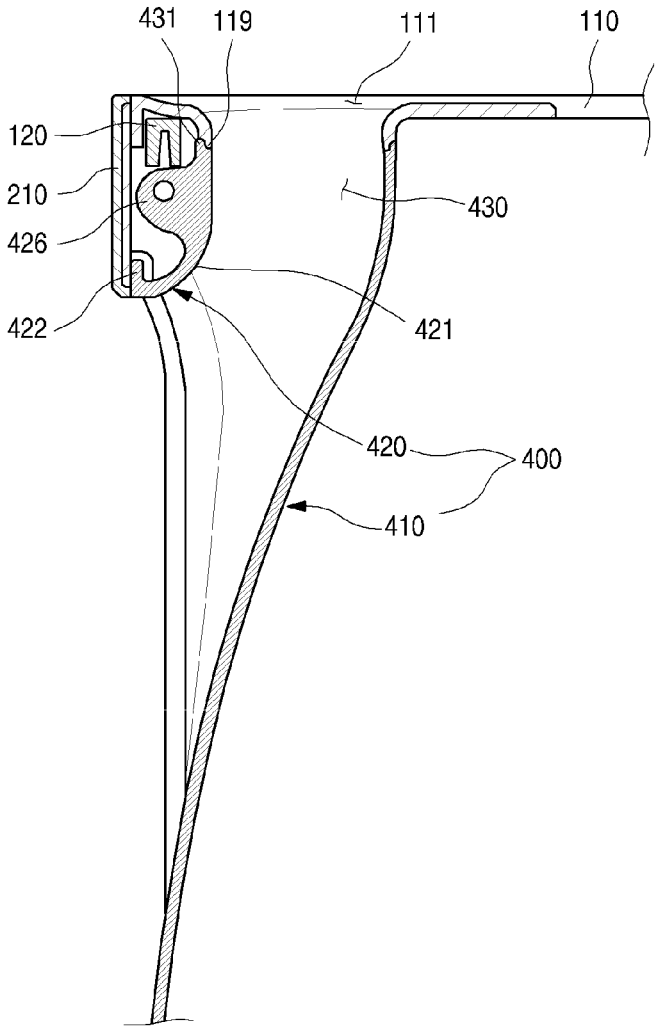
FIG. 13 is a cross-sectional view taken along line 13-13' of FIG. 1.

FIG. 11 is an exploded perspective view illustrating a coupling structure of the side deco that is one component of the dehumidifier. FIG. 12 is an exploded perspective view of the side deco. FIG. 13 is a sectional view taken along line 13-13' of FIG. 1.

Referring to FIGS. 11 to 13, the side deco 400 may define a portion of a side surface of the dehumidifier 1. The side deco 400 may be disposed between the top cover assembly 100 and the base pan 11 so that upper and lower ends of the side deco 400 are respectively fixed to the top cover assembly 100 and the base pan 11. The side deco 400 may be disposed between the front case 200 and the rear case 300 so that a front end of the side deco 400 is coupled to the front case 200, and a rear end of the side deco 400 is coupled to the rear case 300.

A plurality of deco coupling parts 312 may be disposed along both ends of the back surface of the rear case 300. The deco coupling parts 312 may be coupled to the side deco 400 and vertically spaced a predetermined distance from each other along a side end of the rear case 300. Also, the deco coupling parts 312 may restrict both left and right ends of the side deco 400 to couple the rear case 300 to the side deco 400.

The deco coupling parts 312 may be also disposed on both left and right sides of the front case 200. The deco coupling parts 312 may have the same structure and shape except for its position. Thus, the deco coupling parts 312 may be disposed to have the same structure and shape on the front case 200 and the rear case 300. Thus, all of the front case 200 and the rear case 300 may have structures that are coupled to being coupled and fixed to the side deco 400.

The side deco 400 may have a vertically long plate shape and includes a deco member 410 and a handle member 420. The deco member 410 may define a side shape of the dehumidifier 1. The deco member 410 has an upper end contacting a bottom surface of the cover plate 110 and a lower end contacting the base pan 11.

The handle member 420 may be coupled to an upper portion of the deco member 410. An upper end of the handle member 420 may be coupled to the cover plate 110 and disposed on an inner side surface of the front extension part 210 and the rear extension part 310 to form the handle 40.

In detail, the deco member 410 has a rectangular plate shape. When the side deco 400 is mounted, both left and right ends of the deco member 410 may be inserted into and restricted by the front case 200 and the rear case 300. Thus, when the front case 200 and the rear case 300 are coupled to each other, both ends of the deco member 410 may be restricted between the front case 200 and the rear case 300 and then maintained in the restricted state. A lower end of the deco member 410 may be inserted into and fixed to the base pan 11, and an upper end of the deco member 410 may be fixed to match the cover plate 110.

An upper portion of the deco member 410 may be rounded inward, and the handle member 420 may be disposed on the upper end of the deco member 410. Both side ends of the deco member 410 and handle member 420 may be coupled to each other to define an opening 430 in a space therebetween. Both side ends of the deco member 410 and handle member 420 may be spaced apart from each other by a distance corresponding to the handle hole 111 to form a portion of the handle 40.

To couple the deco member 410 to the handle member 420, a handle coupling protrusion 412 protruding in a direction of the handle member 420 may be disposed on each of both sides of the deco member 410. An end of the handle coupling protrusion 412 may be bent and hooked with the handle member 420.

A deco fixing part 415 extending in a lateral direction may be disposed on each of both sides of the deco member 410. The deco fixing part 415 may be coupled to the handle coupling part 424. Here, the deco fixing part 415 and the handle coupling part 424 may be fixed by the screw S that is coupled to pass through the handle coupling part 424 and the deco fixing part 415.

A seating rib (see reference numeral 440 of FIG. 3) extending in a horizontal direction and protruding inward may be further disposed on a back surface of the deco member 410. The seating rib 440 may protrude from the back surface of the deco member 410 and be disposed at a position corresponding to an upper end of the horizontal part 620 of the frame 600. Thus, when the deco member 410 is mounted, the seating rib 440 may be seated on and supported by the upper end of the horizontal part 620.

Both ends of the handle member 420 may be coupled to the deco member 410. Also, each of both ends of the handle member 420 may be rounded to have a curvature corresponding to that of the handle hole 111. Thus, both ends of the handle member 420 may form a space therebetween, into which the user's hand is inserted when the handle member 420 is coupled to the deco member 410.

A round part 421 having a curvature in a vertical direction may be disposed on the handle member 420. The round part 421 may protrude outward toward a lower side thereof so that the user is inserted to grasp an inner surface of the handle member 420. A handle support 422 extending upward to contact the inner surfaces of the front extension part 210 and rear extension part 310 may be further disposed on a lower end of the handle member 420. Thus, even though the user grasps the handle 40, the handle 40 may be stably maintained without being damaged.

A handle coupling hole 423 into which the handle coupling protrusion 412 is inserted may be defined in each of both left and right ends of the handle member 420. The handle coupling hole 423 may be lengthily defined in a vertical direction so that the handle coupling protrusion 412 moves downward after being inserted into the handle coupling hole 423 to restrict the handle member 420 by the handle coupling protrusion 412.

The handle coupling part 424 extending bilaterally may be disposed on each of both left and right ends of the handle member 420. The handle coupling part 424 may be disposed at a position corresponding to the deco coupling part 415, and the screw S may pass through the handle coupling part 424.

The handle member 420 may have a vertical width corresponding to the front extension part 210 and the rear extension part 310. Also, the lower end of the handle member 420 may have a curvature corresponding to that of a lower end of each of the front extension part 210 and the rear extension part 310. Thus, when the front case 200 and the rear case 300 are coupled to each other, the handle 40 may be stably formed without being exposed to the outside.

The handle member 420 and the deco member 410 may be coupled to each other to allow the upper end of the side deco 400 to form the opening 430. The opening 430 has a shape corresponding to that of the handle hole 111. Also, the opened circumference of the handle hole 111 may extend to be rounded downward. The rib stepped part 119 is disposed on a lower end of the handle hole 111. The deco stepped part 431 may be disposed on the upper end of each of the deco member 410 and the handle member 420, which corresponds to the rib stepped part 119 may be disposed so that the deco stepped part 431 and the rib stepped part 119 match each other.

Thus, the coupling structure between the front case 200 and the rear case 300 and between the side deco 400 and the cover plate 110 may provide the stable handle structure as well as the fixing of the side deco 400.

Figure 14:
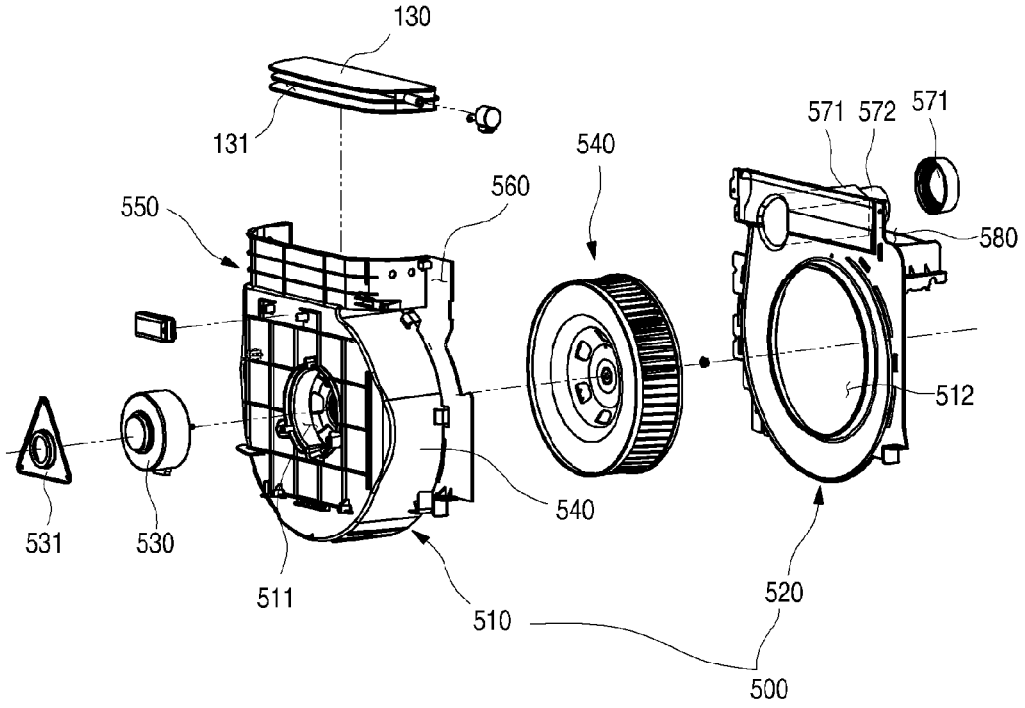
FIG. 14 is an exploded perspective view of a housing assembly that is one component of the dehumidifier.

FIG. 14 is an exploded perspective view of the housing assembly that is one component of the dehumidifier. The motor 530 and blowing fan 540 for forcibly blowing air are mounted on the housing assembly 500. The housing assembly 500 is seated on an upper portion of the horizontal part 620 of the frame 600. The housing assembly 500 includes a housing case 510 and a housing cover 520. The housing cover 520 and the housing case 510 may be coupled to each other to form a space in which the blowing fan 540 is accommodated and a space through which air flows.

The housing case 510 has a shape of which a rear surface is opened to form the space in which the blowing fan 540 is accommodated, and a top surface is opened to allow the louver 130 to be mounted. Also, the opened entire rear surface of the housing case 510 may be covered by the housing cover 520 having a shape corresponding thereto.

A motor accommodation part 511 for accommodating the motor 530 is recessed from a front surface of the housing case 510. A rotation shaft of the motor 530 may pass through the housing case 510 to extend inward. A BLDC motor having a relatively long life-cycle and easily controlled in rotation rate may be used as the motor 530 for rotating the blowing fan 540. The motor 530 may be fixedly mounted on the housing case 510 by the motor bracket 531.

The blowing fan 540 that axially suctions air to radially discharge the suctioned air may be disposed in an inner space of the housing case 510. A sirocco fan having less noises and superior blowing performance may be used as the blowing fan 540. Air introduced into the housing case by the rotation of the blowing fan 540 may flow along the inner surface of the housing case 510 and then be discharged to the outside through the louver 130.

The inner surface of the housing case 510 may have a curved shape to improve the flow of the air. A curved part 540 having a curvature corresponding to that of the inside may be disposed on one side surface of both side surfaces of the housing case 510. The curved part 540 may be formed from a lower end of the housing case 510 to a louver mounting part 550 on which the louver 130 is mounted. A capacitor mounting part 560 on which a capacitor 595 is mounted may be exposed between the curved part 540 and the louver mounting part 550. The curved part 540 of the housing case 510 may be formed along the curvature of the inner surface of the housing case 510 to form the capacitor mounting part 560.

The housing cover 520 may have a plate shape corresponding to that of the housing case 510. An orifice 521 defining a passage through which the air is suctioned may be defined to be opened in the housing cover 520. The accessory connection part 570 may be disposed on a portion of an upper portion of the housing cover 520. The accessory connection part 570 may have a shape to allow the inside of the housing case 510 on which the louver 130 is mounted to communicate with an external space. The accessory connection part 570 may have an end with a shape corresponding so that the end passes through the accessory hole 320 and is exposed to the outside.

A connection part cap 571 is detachably mounted on the end of the accessory connection part 570. The connection part cap 571 covers the opened end of the accessory connection part 570 to prevent the air from leaking to the outside. A rotation coupling part 572 may be disposed on an end of the accessory connection part 570 to couple the connection cap 571 to the accessory connection part 570. The connection cap 571 may rotate to detach the rotation coupling part 572 from the accessory connection part 570. After the connection cap 571 is separated, an extension hose or other accessories may be simply coupled to the rotation coupling part 572 through rotation manipulation thereof.

A control box mounting part 580 may be disposed above the orifice 521. The control box mounting part 580 may extend backward from a back surface of the housing cover 520 to vertically partition the space in which the heat exchange module 30 is disposed. Thus, a control box 590 for controlling an operation of the dehumidifier 1 may be mounted on the control box mounting part 580.

The control box mounting part 580 may be disposed at a position corresponding to that of the capacitor mounting part 560. Thus, the capacitor 595 may be disposed at the same height as the control box 590 and connected to the control box 590 at the shortest distance.

The heat exchange module 30 is disposed below the control box mounting part 580. The heat exchange module 30 is seated on the horizontal part 620 of the frame 600 and has a size corresponding to a space defined between the control box mounting part 580 and the horizontal part 620.

The heat exchange module 30 may include an evaporator 31 connected to the compressor 20 and heat-exchanged with air introduced into the dehumidifier 1 and a condenser 32 connected to the evaporator 31 and in which a refrigerant flowing therethrough is heat-exchanged with the air passing through the evaporator 31. The evaporator 31 and the condenser 32 are installed in parallel and disposed in a front/rear direction. Thus, the air heat-exchanged with the refrigerant while passing through the evaporator 31 may be heat-exchanged again with the refrigerant while passing through the condenser 32.

That is, the refrigerant supplied to the compressor 20 may flow toward the condenser 32 through the evaporator via an expansion unit and then be introduced again into the compressor 20. Also, the air suctioned into the dehumidifier 1 may be introduced into the housing assembly 500 via the orifice 521 while successively passing through the evaporator 31 and the condenser 32 and then be discharged again to the outside. The indoor air suctioned through the suction hole 331 may be heat-exchanged while passing through the evaporator 31 to decrease in temperature. Moisture contained in the air may be liquefied and separated from the air to generate dehumidified air.

The air separated from the moisture while passing through the evaporator 31 may be heated while passing through the condenser 32 and then dried. The dried air may be discharged into the external space of the dehumidifier 1 through the discharge hole 131 in the state of the dehumidified air from which the moisture is removed. Since the evaporator 31 and the condenser 32 are arranged in parallel, the air passing through the suction hole 331 may be dehumidified while passing through the evaporator 31 and heated (dried) while passing through the condenser 32.

The moisture separated from the air while passing through the evaporator 31 may be liquefied to change into a liquid state. The phase-changing condensed water may flow along a drain passage 621 defined in the horizontal part 620 of the frame 600 and then be collected into the water tank 800. See FIG. 16. A lower end of the condenser 32 may be inserted into the horizontal part 620, and the condensed water may flow via an area on which the condenser is mounted. When at least a portion of the lower end of the condenser 32 is accommodated into the inner space of the drain passage 621, the condenser 32 may be cooled by the condensed water flowing along the drain passage 621 to improve efficiency of the condenser 32.

Figure 15:
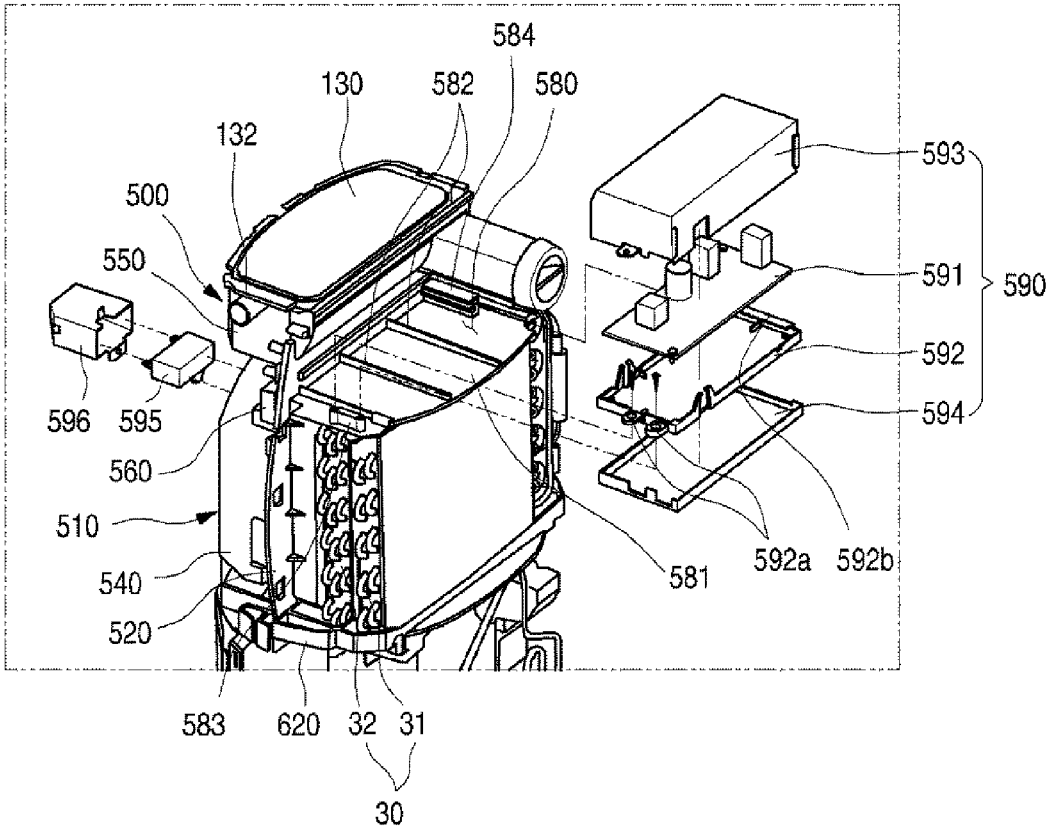
FIG. 15 is an exploded perspective view illustrating a coupling structure of a PCB assembly that is one component of the dehumidifier.

FIG. 15 is an exploded perspective illustrating a coupling structure of a PCB assembly that is one component of the dehumidifier. When the control box mounting part 580 is disposed on the housing assembly 500, the control box 590 is mounted on the control box mounting part 580. The control box mounting part 580 may be disposed at a rear side of the louver 130 mounted on the housing assembly 500 to form a seating surface 581 that extends backward. A pair of ribs 582 protruding upward is disposed on the seating surface 581. Each of the ribs 582 lengthily extend in a front/rear direction to support a lower portion of the control box 590.

A box fixing part 583 protrudes from one side of the seating surface 581. The box fixing part 583 may be disposed at a position corresponding to a box coupling part 592*a* that extends laterally from one side of the control box 590. The screw S may pass through the box coupling part 592*a* and then be coupled to fix the control box 590. A box guide 584 is disposed on one side facing the box fixing part 583. The box guide 584 is lengthily disposed in a front/rear direction so that a guide piece 592*b* of the control box 590 is slidably inserted.

When the control box 590 is mounted, the guide piece 592*b* of the control box 590 may move backward and be inserted into the box guide 584. When the control box 590 completely moves, the box coupling part 592*a* may be disposed at a position that overlaps the box fixing part 583. In this state, the screw S may be coupled from an upper side to fixedly mount the control box 590 on the control box mounting part 580. If a service for the control box 590 is required, the coupling of the screw S may be released, and then the control box 590 may be slid backward to easily separate the control box 590.

The control box 590 includes the PCB 591 on which various devices for controlling the operation of the dehumidifier 1 are mounted, a board base 592 formed of a plastic material to accommodate the PCB 591, and a board case surrounding upper and lower portion of the board base 592. The board base 592 defines a space in which the PCB 591 is accommodated. The box coupling part 592*a* and the guide piece 592*b* protrude outward from both ends of the board base 592, respectively.

The board case 154 includes an upper case 593 and a lower case 594. The board base 592 in which the PCB 591 is accommodated may be mounted in a space between the upper case 593 and the lower case 594. The board case 154 is formed of a metal material such as stainless steel. Even though fire occurs in the PCB 591, the combustion may occur only within the board case 154 to prevent the fire from being spread to other component of the dehumidifier 1.

The capacitor mounting part 560 is further disposed at a font side of the control mounting part 580. The capacitor mounting part 560 is disposed adjacent to the control box mounting part 580. The capacitor 595 is accommodated into the capacitor cover 596 having an accommodation space therein. The capacitor cover 596 may be coupled to the capacitor mounting part 560.

The capacitor 595 may be fixed to the capacitor mounting part 560. The capacitor cover 596 formed of a metal material such as stainless steel may completely surround the capacitor 595 to protect the capacitor 595 against the fire. The capacitor 595 may have a relatively high height. Thus, if the capacitor 595 increases in capacitance, the capacitor may further increase in size. Thus, since the capacitor 595 and the capacitor cover 596 are separated from the control box, the mounting space of the control box 590 may be more utilized, and also the inner space of the dehumidifier 1 may be efficiently used.

Figure 16:
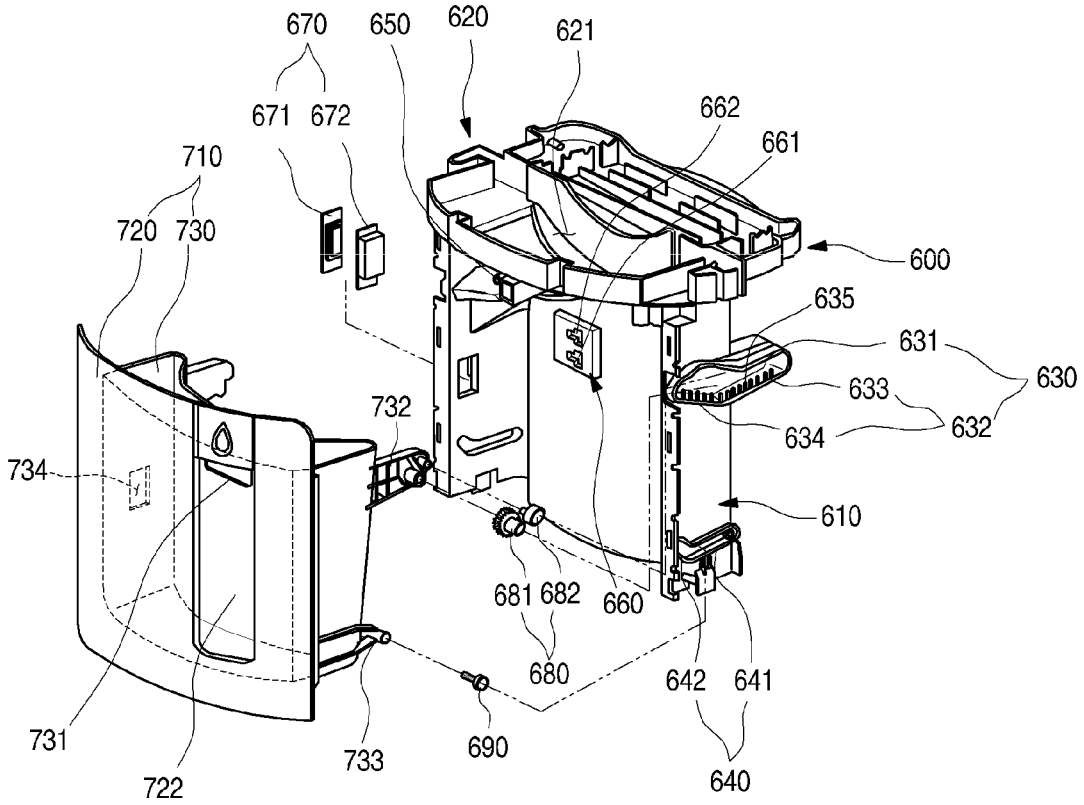
FIG. 16 is an exploded perspective view illustrating a coupling structure of a water tank assembly that is one component of the dehumidifier.
Figure 17:
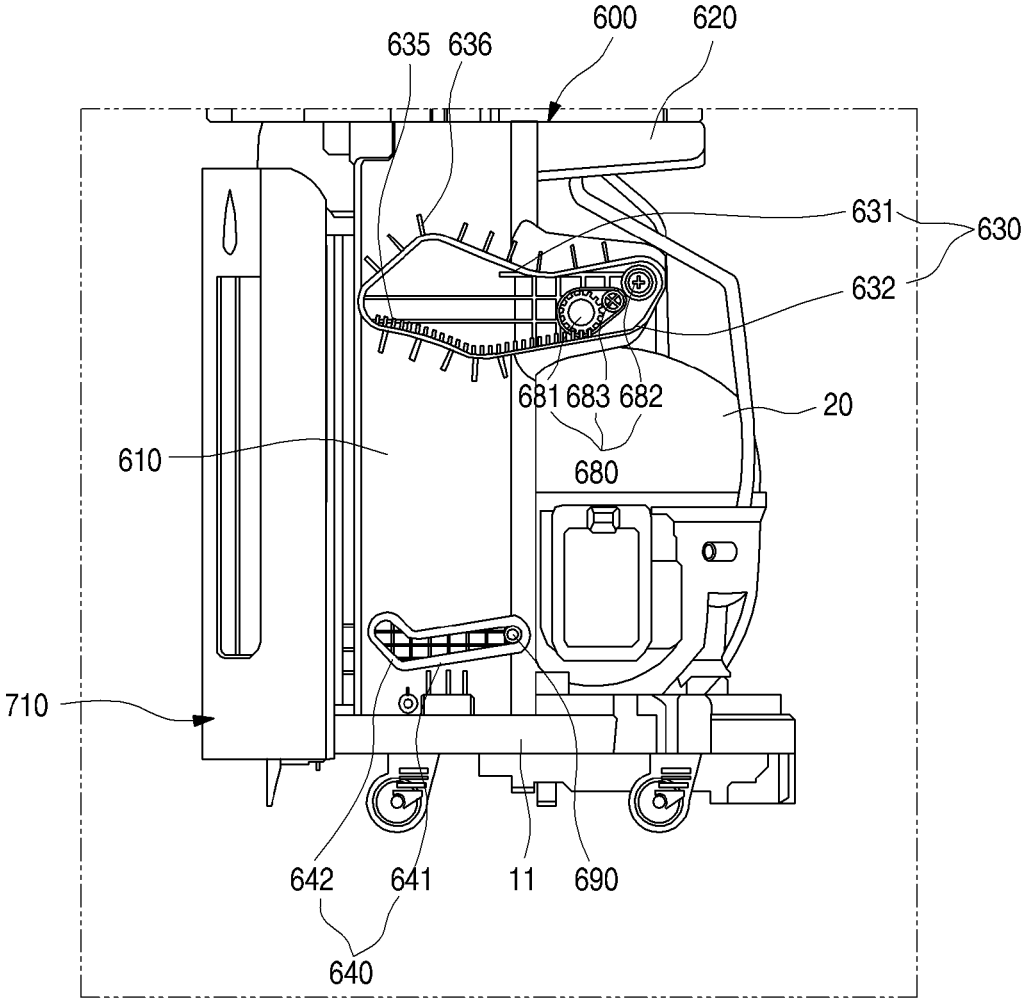
FIG. 17 is a side view illustrating a structure of a guide assembly for guiding insertion/withdrawal of the water tank assembly.

FIG. 16 is an exploded perspective view illustrating a coupling structure of the water tank assembly that is one component of the dehumidifier. FIG. 17 is a side view illustrating a structure of a guide assembly for guiding insertion/withdrawal of the water tank assembly. The water tank assembly 700 is disposed at a front side of the vertical part 610 of the frame 600. A space in which a tank drawer 710 constituting the water tank assembly 700 is accommodated is defined in the front side of the vertical part 610. When the water tank 800 is completely inserted, the tank drawer 710 may disposed on the same plane as a front surface of the cover plate 110. See FIG. 18.

A latch 650 into which the locker 724 is inserted to selectively restrict the locker 724 is disposed on a central portion of the front surface of the frame 600, particularly, a front end of the horizontal part 620. The latch 650 is disposed at a position corresponding to the latch hole 222. When the tank drawer 710 is closed, the latch 650 is hooked with the locker 724 to maintain the closed state of the tank drawer 710. See FIG. 24.

When the latch 650 is inserted once, the latch 650 is hooked with the locker 724. When the locker 724 moves again forward by an external force, the hooking between the latch 650 and the locker 724 may be released to allow the tank drawer 710 to be withdrawn. That is, the locking structure between the latch 650 and the locker 724 may be similar to a latching structure such as a general pushing manner.

The locking unit including the latch 650 and the locker 724 may have a locking structure different from the structures of the latch 650 and the locker 724. Also, various structures for maintaining the closed state of the tank drawer 710 may be selectively applied.

A full level detection part 660 is disposed on the front surface of the vertical part 610 toward the tank drawer 710. A pair of sensors are vertically disposed on the full level detection part 660 to determine a full level of water by detecting a position of a floater of the water tank 800.

When a position of the floater 830 (see FIG. 18) is detected by the sensor for detecting the full level of the water tank 800, a lower water level sensor 661 of the pair of sensors transmits a full level signal to the display part 152 to inform the full level of the water tank 800. When a position of the floater is detected by an upper safety sensor 662 of the pair of sensors, the operation of the dehumidifier 1 may be stopped to prevent the condensed water from being further collected into the water tank 800. The full level may be informed to the outside to allow the user to empty the water tank 800.

A lighting module 670 is mounted on one side of the vertical part 610 corresponding to a lateral side of the tank drawer 710. The lighting module 670 irradiates light into the water tank 800 to visualize a water level of the water tank 800 and function as an indirect lighting. The light may be irradiated form one side toward the inside of the water tank 800. The lighting module 670 may include a light emitting part 671 for emitting light and a scattering member 672 disposed at a front side of the light emitting member 671 to scatter the light emitted from the light emitting member 671.

A device that is capable of emitting light such as an LED may be used as the light emitting member 671. Alternatively, different materials that are capable of emitting light may be used. The light emitting member 671 may emit a plurality of colors. The light emitted from the light emitting member 671 may change in color according to a state of the dehumidifier 1.

For example, the color of the light emitted from the light emitting member 671 may change according to the water level detected by the full level detection part 660. That is, in case of a normal water level, lighting having a blue color may be emitted. In case of a full level, i.e., light having a yellow color may be emitted. In case of a dangerous level, light having a red color may be emitted. Thus, the user may recognize the water level by using the color seen through an identification window 722 to empty the water tank.

In the humidity of the air suctioned into the dehumidifier 1, in case of normal humidity, a blue color may be expressed. In case of the normal humidity or more, a yellow color may be expressed. In case of high humidity at which the dehumidification is required, a red color may be expressed. For this, a humidity sensor 370 for detecting external humidity may be further disposed on one side of the dehumidifier 1. The humidity sensor 370, the lighting module, and the full level detection part 660 may be connected to the control box 590 to realize the visualization using the water tank 800 according to the state of the dehumidifier 1.

The scattering member 672 may be formed of a transparent or translucent material so that the light emitted from the light emitting unit 672 passes through the scattering member 672. The scattering member 672 may cover the light emitting member 671 to protect the light emitting member 671.

The light emitted from the light emitting member 671 may be reflected or refracted by the scattering member 672 so that the light is uniformly smoothly emitted into the water tank 800. The light emitted from the light emitting member 671 may light the whole water tank 800.

The lighting module 670 may operate to light the whole inside of the water tank 800. The light may be emitted to the outside through the identification window 722 to function as the indirection lighting. The operation state of the dehumidifier 1 may be identified at a long distance through the color identified through the identification window 722. Although not shown, a lighting hole may be defined in a side surface of the tank drawer 710 or a position corresponding to the lighting module 670 to emit light into the water tank 800 in a state where the water tank 800 is accommodated into the tank drawer 710.

The main guide 630 and the sub guide 640 are disposed on both left and right sides of the vertical part 610, respectively. The main guide 630 and the sub guide 640 may guide the slidable insertion/withdrawal and tilting of the tank drawer 710. The main guide 630 and the sub guide 640 may be disposed on both left and right sides of the vertical part 610. The sub guide 640 may be disposed below the main guide 630.

The main guide 630 may be disposed on an upper portion of the vertical part 610 to define a passage through which a rolling unit 680 that will be described below moves. The main guide 630 may include a lower part 632 defining a lower portion thereof and an upper part 631 defining an upper portion thereof. The upper part 631 and the lower part 632 may have tilts or curvatures corresponding to each other. Both ends of the upper part 631 and the lower part 632 may be connected to each other to form a close loop shape on the whole. The lower part 632 may include a downward tilted part 633 having a tilt that is gradually tilted downward toward a front side from a rear side and an upward tilted part 634 having a tilt that is gradually tilted upward toward a front side from an end thereof.

When the tank drawer 710 is closed, the rolling unit 680 may be disposed at the rearmost position of the main guide 630 and the highest position of the downward tilted part 633. When the tank drawer 710 is opened and tilted, the rolling unit 680 may move along the main guide 630. Also, when the tank drawer 710 is completely withdrawn and tilted, the rolling unit 680 may be disposed at the foremost position of the main guide 630 and the highest position of the upward tilted part 634.

A gear part 635 is disposed inward form each of the downward tilted part 633 and the upper tilted part 634. The gear part 635 has a rack structure. The gear part 635 may have a teeth shape so that a rolling gear 681 disposed on the rolling unit 680 moves along the gear part 635.

The upper part 631 may contact a main roller 682 of the rolling unit 680. When the tank drawer 710 moves, the main roller 682 may move along the upper part 631 in the state where the main roller 682 contact an inner surface of the upper part 631. A plurality of reinforcing ribs 636 vertically extending from edges of the main guide 630 and the vertical part 610 may be disposed around an outer circumference of the main guide 630. The plurality of reinforcing ribs 636 are disposed spaced a predetermined distance from each other to prevent the main guide 630 from being deformed by a load applied to the main guide 630.

The sub guide 640 is disposed below the main guide 630 to accommodate a sub roller 690 that will be described below. The sub guide 640 has a diameter corresponding to that of the sub roller 690. The sub guide 640 includes a withdrawal part 641 for guiding the withdrawal of the tank drawer 710 and a tilting part 642 for guiding the tilting of the tank drawer 710 at an end of the withdrawal part 841. The withdrawal part 641 has a downward tilt, and the tilting part 642 has an upward tilt.

The water tank assembly 700 may collect condensed water generated in the heat exchange module 30. The water tank assembly 700 is disposed in a space defined in a front side of the frame 600. The water tank assembly 700 is connected to the frame 600 and slid to be inserted or withdrawn in a front/rear direction. When the water tank assembly 700 is completely withdrawn, the water tank assembly may rotate by using a lower portion thereof as a shaft and then be tilted to open a top surface thereof.

The water tank assembly 700 may include a water tank 800 for storing the condensed water and a tank drawer 710 in which the water tank 800 is accommodated and inserted/withdrawn so that the water tank 800 is easily mounted or separated.

The tank drawer 710 may define an outer appearance of a front surface of the water tank assembly 700. The water drawer 710 may include a front surface part 720 defining a portion of the front surface of the dehumidifier 1, i.e., a portion of the front case 200 and an accommodation part 730 opened upward from a rear side of the front surface part to accommodate the water tank downward from an upper side.

The accommodation part 730 may have a shape corresponding to that of the water tank 800. The accommodation part 730 may be opened upward so that water is easily supplied, and the water tank 800 is easily inserted or withdrawn in the state where the water tank 800 is mounted.

The locker 724 extending backward is disposed on a central portion of an upper end of the front surface part 720. The locker 724 may extend backward and be coupled and fixed to the latch 650 in a state where the water tank assembly 700 is completely inserted.

The identification window 722 for identifying a water level of the water tank 800 mounted on the accommodation part 730 through a naked eye may be further disposed on one side of the front surface part 720. The identification window 722 is lengthily disposed in a vertical direction. Also, the identification window 722 may be disposed so that at least a portion of the water tank 800 is exposed. Thus, a water level of the water tank 800 may be identified from the outside through the identification window 722.

The identification window 722 may be lean to one side of left and right sides of the front surface part 720. The identification window 722 may be disposed on one side that is away from the lighting module 670. Thus, when light is emitted from the lighting module 670, locally strong light may not be irradiated through the identification window 722, but be smoothly uniformly irradiated through identification window 722 in a state where the light is scattered by the water within the water tank 800.

The identification window 722 may be formed by simply opening the front surface part 720. As necessary, the identification window 722 may be covered by a transparent material so that the inside of the water tank 800 is seen from the outside. For using the light within the water tank 800 as an indirect lighting, a specific color or pattern may be disposed on the transparent material of the identification window 722.

When the light is irradiated into the water tank 800 by the lighting module 670, the light irradiated into the water tank 800 may leak to the outside through the identification window 722 so that the inside of the water tank 800 may be identified, and also, the light is used as the indirect lighting such as a mood lamp.

For this, an opened transmission part 734 may be disposed on a side surface of the accommodation part 730. The transmission part may be opened at a position corresponding to the lighting hole and the lighting module 670 in the state where the tank drawer 710 is closed. Thus, when the lighting module 670 operates, the light emitted from the lighting module 670 may be irradiated into the water tank 800 from one side of the water tank 800 via the lighting hole and the transmission part to light the inside of the water tank 800.

A detection hole 731 for detecting a water level is opened in a rear surface of the accommodation part 730. The detection hole 731 is opened in a shape corresponding to that of the full level detection part 660. The full level or dangerous level within the water tank 800 may be easily detected through the detection hole 731.

An upper extension part 732 and lower extension part 733, which extend backward may be provided in a pair on both sides of the accommodation part 730. The upper extension part 732 may extend upward from the accommodation part 730, and the lower extension part 733 may extend backward from the lowest portion of the accommodation part 730.

The upper extension part 732 may further extend backward from the lower extension part 733. The rolling unit 680 may be mounted on an end of the upper extension part 732, and the sub roller 690 may be mounted on a rear end of the lower extension part 733 so that the tank drawer 710 is inserted/withdrawn and tilted.

The rolling unit 680 may be disposed on a rear end of the upper extension part 732 and engaged with the gear part 635 of the main guide 630. The rolling unit 680 includes a rolling gear 681 moving along the gear part 635, a damper 683 for buffering a rotation rate and impact of the rolling gear 681, and a main roller 682 contacting the upper part 631 of the main guide 630.

The rolling gear 681 and the main roller 682 may respectively contact the lower part 632 and the upper part 631 to allow the tank drawer 710 to be inserted/withdrawn or tilted. The rolling gear 681 may move along the gear part 635 of the lower part 632, and the main roller 682 may contact an inner circumferential surface of the upper part 631 to support the upper part 631.

The water tank assembly 700 that is slidably inserted/withdrawn and tilted may not be vertically shaken, as wall as, the tank drawer 710 may not lean by the coupling between the gear part 635 and the rolling gear 681. Thus, the water tank assembly 700 may be stably inserted or withdrawn.

The damper 683 is disposed on one side of the rolling gear 681. When the rolling gear rotates, the damper 683 may reduce a rotation rate of the rolling gear 681 so that the tank drawer 710 stably rotates. An operation structure of the tank drawer 710 will be described below in more detail.

Figure 18:
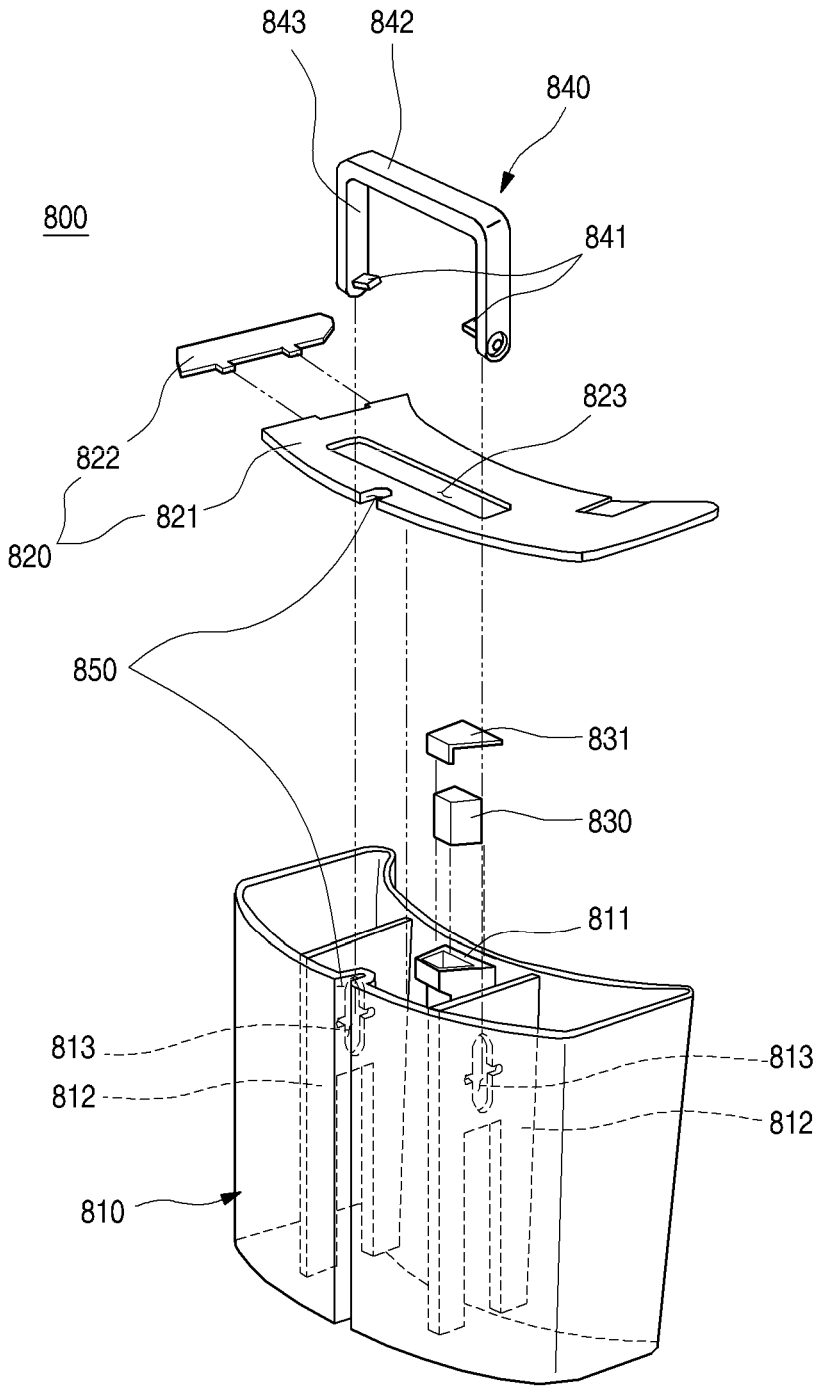
FIG. 18 is a perspective view of a water tank that is one component of the dehumidifier.

FIG. 18 is a perspective view of the water tank that is one component of the dehumidifier. The water tank 800 may have a shape corresponding to an inner shape of the accommodation part 730. The water tank 800 may include a lower transparent water collection part 810 and an upper water collection part cover 820.

The water collection part 810 may be formed of a transparent acrylic or plastic material so that the inside of the water tank 800 is seen from the outside, and the water collection part 810 is easily molded. A floater accommodation part 811 for accommodating the floater 830 is disposed inside the water collection part 810. The floater accommodation part 811 may be opened upward and define an independent space. The floater accommodation part 811 lengthily disposed in a vertical direction to secure a moving path of the floater 830 and maintain the same water level as the inside of the water tank 800. The floater 830 is accommodated into the floater accommodation part 811. The floater 830 may vertically move according to a water level.

The floater accommodation part 811 may be disposed at a position corresponding to the full level detection part 660. A position of the floater 830 which includes a magnet therein and moves along the floater accommodation part 811 may be detected by a sensor of the full level detection part 660. The opened top surface of the floater accommodation part 811 may be covered by the floater cover 831 to prevent the floater 830 from being lost and locate the floater 830 within the floater accommodation part 811.

A pair of handle mounting part 812 is disposed within the water tank 800. A tank handle 840 to be grasped by the user to move the water tank 800 may be disposed on the handle mounting part 812. A mounting hole 813 lengthily defined in a vertical direction may be defined in the handle mounting part 812.

A mounting protrusion 841 of the tank handle 840 has a structure that is inserted into the mounting hole 813. The tank handle 840 may vertically move along the mounting hole 813. When the user separates or move the water tank 800, the tank handle 840 may be withdrawn upward. When the water tank 800 is mounted on the water drawer 710, the tank handle 840 may move downward to insert the water handle 840 into the water collection part cover 820.

The water collection part cover 820 may cover the opened top surface of the water collection part 810. The water collection part cover 820 may include a cover part 821 covering the top surface of the water collection part 810 and an opening part 822 rotatably disposed on one side of the cover part 821 to open a portion of the top surface of the water collection part 810. When the water filled into the water collection part 810 is discarded, the opening part 822 may rotate to discard the water within the water collection part 810, or the water collection part cover may be separated to discard the water.

A handle hole 823 is defined in the water collection part cover 820. The handle hole 823 may have a size corresponding to a horizontal size of the tank handle 840 to define a passage through which the tank handle 840 is inserted or withdrawn. The tank handle 840 may include a grasping part 842 to be grasped by the user and an extension part 843 extending downward from each of both ends of the grasping part 842. A mounting protrusion 841 protruding inward may be disposed on a lower end of the extension part 843. The mounting protrusion 841 may vertically move along the mounting hole 813 defined in the water collection part 810.

When the tank handle 840 is not used, the tank handle 840 may move downward. In the state where the tank handle 840 is completely inserted, the tank handle 840 may be inserted so that a top surface of the tank handle 840 is disposed on the same plane as a top surface of the water collection part cover 820.

A locker groove 850 recessed backward may be lengthily defined in a vertical direction in each of centers of the water collection part 810 and the water collection part cover 820. When the water tank 800 is mounted, the locker 724 may be inserted into the locker groove 850. The locker may be inserted into the locker groove 850 in the state where the water tank is mounted on the accommodation part 730 to prevent the water tank 800 from moving. When the water tank 800 is inserted or withdrawn, the locker 724 may move along the locker groove 850.

Hereinafter, an operation of the dehumidifier having the above-described structure will be described. First, to operate the dehumidifier 1, the user may locate the dehumidifier 1 in a space to be dehumidified. Since the dehumidifier 1 includes the wheel 12 on the bottom surface thereof and the handle 40 on both sides of the top surface thereof, the dehumidifier 1 may easily move even though the dehumidifier 1 has a large size.

The user may insert a hand thereof into the handle hole 111 defined in the top surface of the cover plate 110 to grasp the handle 40 through the space defined in a side of the side deco 400, thereby stably moving the dehumidifier 1.

When the dehumidifier 1 is placed on a specific position, the user manipulates the dehumidifier 1 to drive the dehumidifier 1. As the dehumidifier 1 is manipulated, the compressor 20 and the motor 530 operate, and the louver 130 rotates to expose the discharge hole 131 to the outside.

As the compressor operates, the refrigerant flows through a refrigerant cycle. The compressor may discharge a high-temperature high-pressure liquid refrigerant. The evaporator 31 may be cooled by low-temperature cool air introduced into the evaporator 31 via the expansion unit. The refrigerant that is heat-exchanged with the external air in the evaporator 31 to changes in phase may flow toward the condenser 32. The refrigerant may be heat-exchanged again in the condenser 32 to return to the compressor 210. Thus, the evaporator may be continuously cooled, and the condenser 32 may be heated due to the above-described refrigerant cycle.

The blowing fan 540 may rotate by the operation of the motor 530. Since the blowing fan 540 rotates, air of an indoor space in which the dehumidifier 1 is disposed may be forcibly suctioned into the dehumidifier 1 through the suction hole 331. The suctioned air may pass through the evaporator 31. While the air passes through the evaporator 31, moisture contained in the air may be condensed while being heat-exchanged with the evaporator 31 to flow along the evaporator 31. The air passing through the evaporator 31 may pass through the condenser 32. The air heated by the condenser 32 may change into dried air and then be introduced into the orifice 521. The air introduced into the orifice 521 may flow along the inner wall of the housing case 510 by the blowing fan 540 and be discharged again into the indoor space through the louver 130.

This process may be repeatedly performed until the humidity of the indoor space reaches a preset humidity or according to the user's set. Generated condensed water of the evaporator 31 may be introduced into the water tank 800 through the drain passage 621 defined in the horizontal part 620 of the frame 600. The condensed water introduced into the water tank 800 may be collected into the water collection part 810. The condensed water may be continuously collected until reaching a preset water level.

When an amount of water collected into the water tank 800 increases to reach the preset water level, the floater 830 may move upward. When a position of the floater 830 is detected by the water level sensor 661, the full level state may be informed by using the display part 152 so that the user discards the water within the water tank 800. When a position of the floater 830 is detected by the safety sensor 662, the operation of the dehumidifier 1 may be stopped to prevent the water within the water tank 800 from overflowing.

The lighting module 670 may operate by the user's manipulation or set during the operation of the dehumidifier 1. When the lighting module 670 operates, the water tank 800 may emit light such as an indirect lighting so that the water level of the water collected into the water tank 800 is easily identified from the outside.

Figure 19:
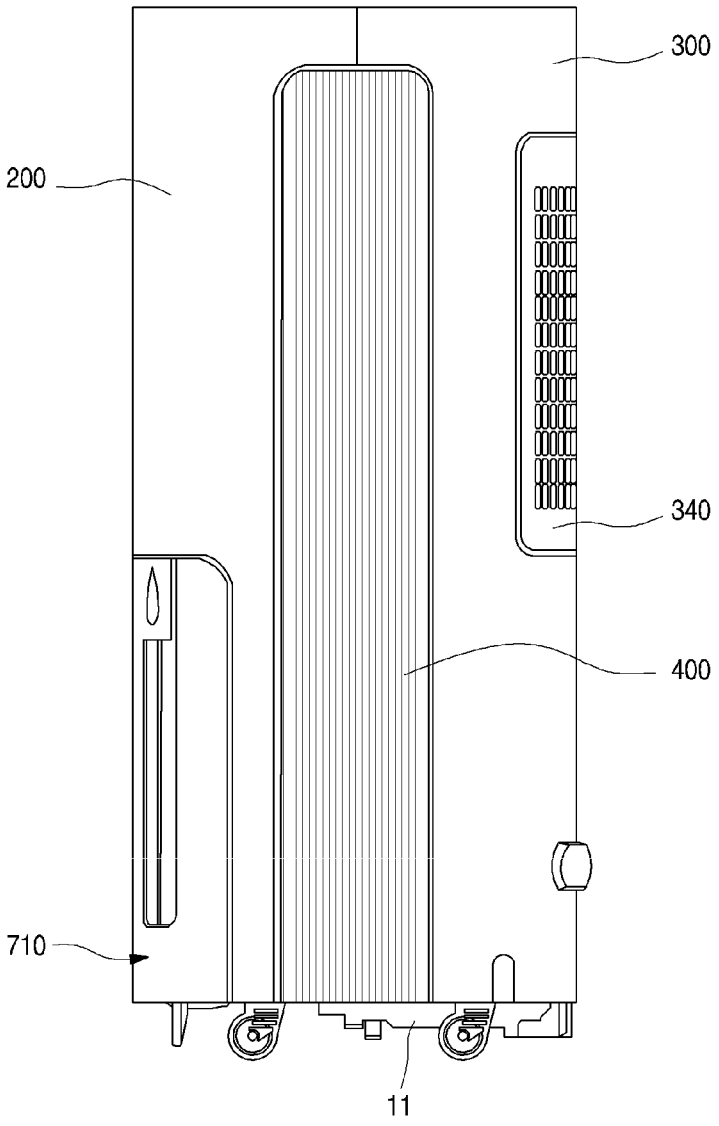
FIG. 19 is a side view of the dehumidifier before the water tank assembly is withdrawn.

FIG. 19 is a side view of the dehumidifier before the water tank assembly is withdrawn. Before the dehumidifier 1 normally operates to reach the full level of the water tank 800, the tank drawer 710 may be maintained in the closed state. In the tank drawer 710 is closed, the front surface of the tank drawer 710 may be disposed on the same plane as the front case 200 to realize a sense of unity.

In this state, the rolling unit 680 may be disposed at the rearmost position of the main guide 630, and the sub roller 690 may also be disposed at the rearmost position of the sub guide 640. In the state where the locker 724 is inserted into the latch 650, the tank drawer 710 may be maintained in the closed state by the restriction between the locker 724 and the latch 650.

Figure 20:
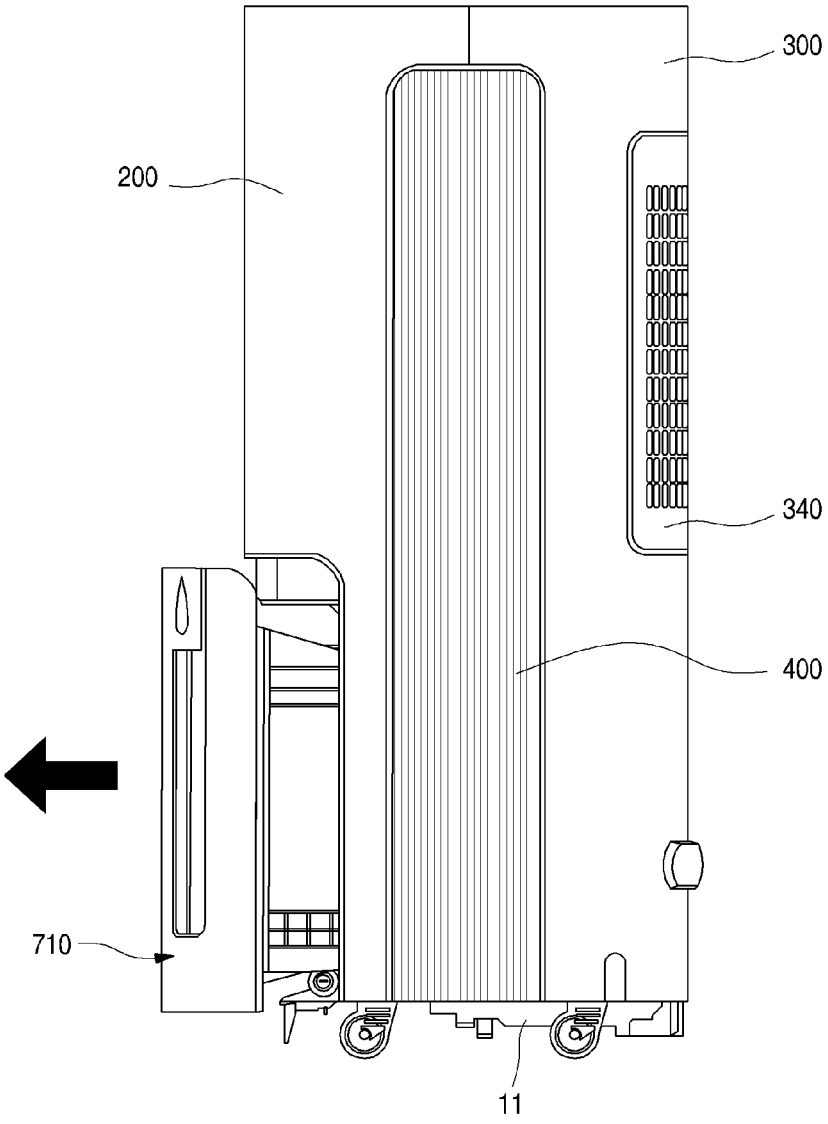
FIG. 20 is a side view of the dehumidifier in a state where the water tank assembly is withdrawn.
Figure 21:
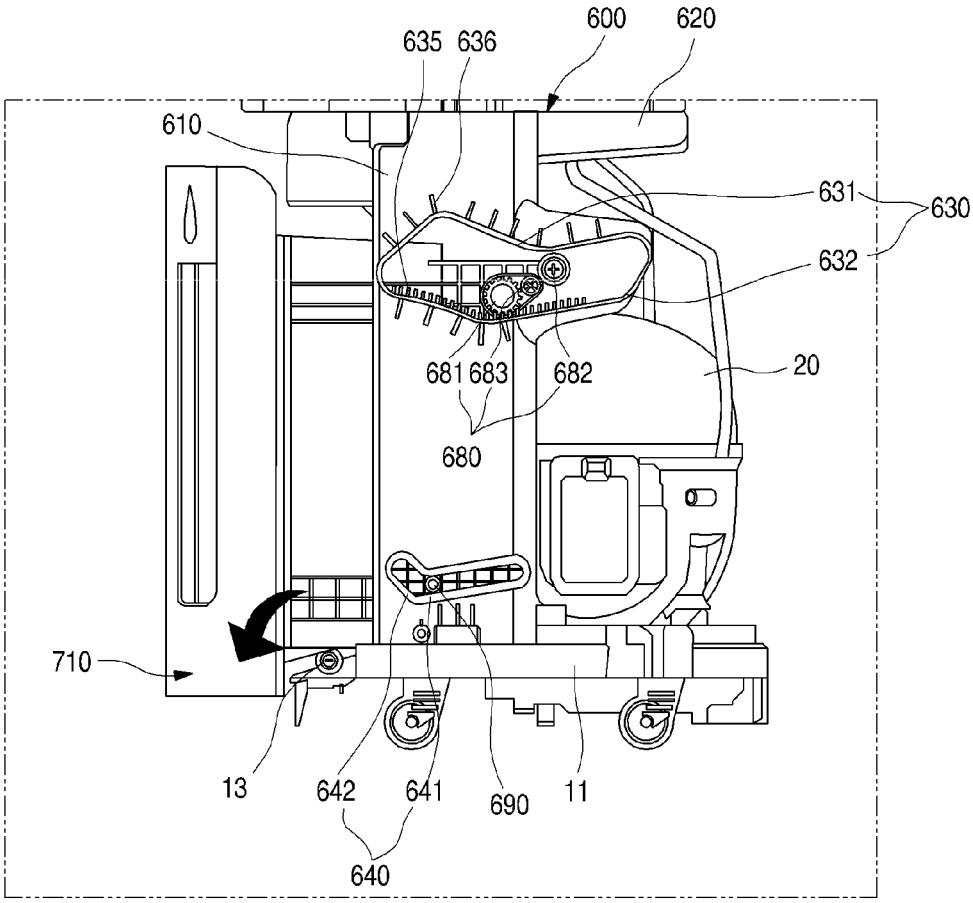
FIG. 21 is a side view of the guide assembly in the state where the water tank assembly is withdrawn.

FIG. 20 is a side view of the dehumidifier in the state where the water tank assembly is withdrawn. FIG. 21 is a side view of the guide assembly in the state where the water tank assembly is withdrawn. The tank drawer 710 may be slidably withdrawn forward till the state of FIGS. 20 and 21.

Referring to FIGS. 20 and 21, to discard the water within the water tank 800, the user may push an upper portion of the tank drawer 710 backward and then release the pushing of the upper portion of the tank drawer 710 that is disposed to correspond to the locker 724 to release the restriction between the latch 650 and the locker 724.

When the restriction between the latch 650 and the locker 724 is released, the rolling gear 681 of the rolling unit 680 may rotate while moving along the gear part 635 disposed on the main guide 630. Here, since the rolling gear 681 moves along the downward tilted part 633 that is tilted downward, the tank drawer 710 in which the water tank 800 is accommodated may be automatically withdrawn by a self-weight thereof.

The damper 683 interlocked with the rolling gear 681 may prevent the rotation rate of the rolling gear 681 from significantly increasing so that the tank drawer 710 is withdrawn forward at a range of a constant rate. The main roller 682 may rolled along the upper part 631 in the state where the main roller 682 contacts the upper part 631 of the main guide 630 to prevent the tank drawer 710 from vertically moving so that the rolling gear 681 stably moves along the gear part 635 while the tank drawer 710 is withdrawn. The sub roller 690 may rolled along the sub guide 640 to move along the downward tilt of the withdrawal part 641 of the sub guide 640.

Figure 22:
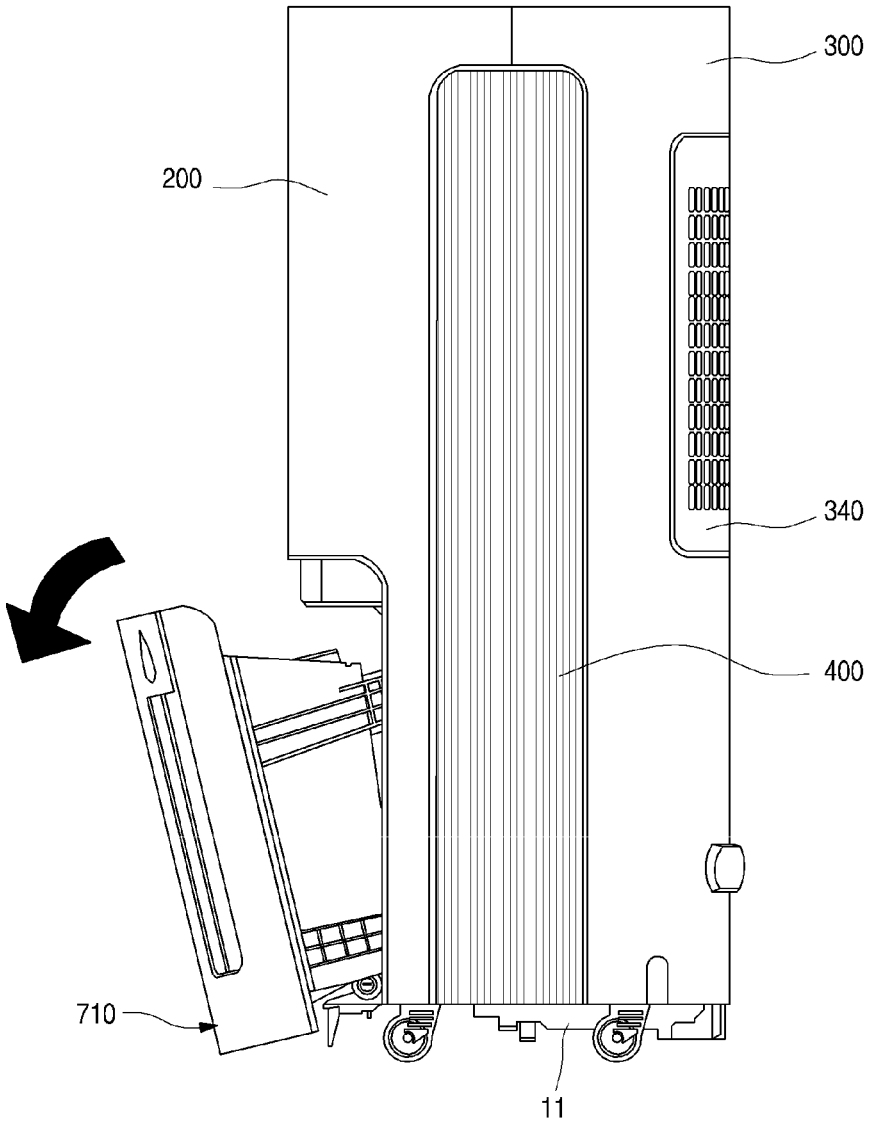
FIG. 22 is a side view of the dehumidifier in a state where the water tank assembly is tilted after being withdrawn.
Figure 23:
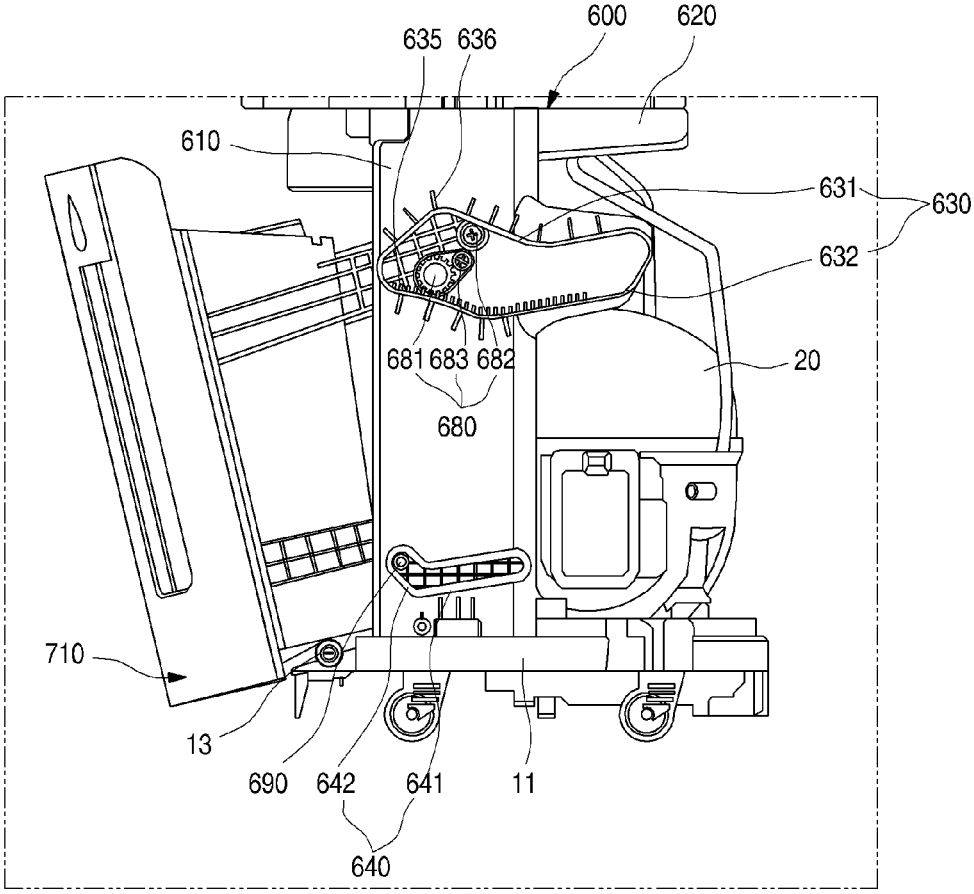
FIG. 23 is a side view of the guide assembly in the state where the water tank assembly is tilted after being withdrawn.

FIG. 22 is a side view of the dehumidifier in a state where the water tank assembly is tilted after being withdrawn. FIG. 23 is a side view of the guide assembly in the state where the water tank assembly is tilted after being withdrawn. The tank drawer 710 may move forward at the maximum rate at a time point at which the rolling gear 681 gets out of the downward tilt. Then, the rolling gear 681 may move along the upward tilted part 634 due to an inertia that moves forward.

The rolling gear 681 may move in the state where the rolling gear 681 is continuously coupled to the gear part 635 of the upward tilted part 634. The moving rate of the rolling gear 681 may gradually decrease due to the upward tilt of the upward tilted part 634. Here, the main roller 682 may be rolled along the upper part 631 in the state where the main roller 682 continuously contacts the upper part 631 to prevent the rolling gear 681 from being separated. While the rolling gear 681 moves, the sub roller 690 may be inserted into the tilting part 642 and rolled. The moving distance of the tilting part 642 may be relatively shorter than that of the upward tilted part 634.

The tank drawer 710 may be supported by the base roller 13 disposed on the base pan 11. When the tank drawer 710 is maximally withdrawn, the weight center may be defined at a front side of a position of the tank drawer 710 that is supported by the base roller to generate a moment. The tank drawer 710 may be tilted while smoothly rotating.

Here, the rolling unit 680 and the sub roller 690 may guide the tilting of the tank drawer 710 while moving along the main guide 630 and the sub guide 640. Also, the tank drawer 710 may be tilted to completely expose the opened top surface of the accommodation part 730 upward. When the tank drawer 710 is completely tilted, the states of FIGS. 17 and 18 may become. Here, the rolling unit 680 and the sub roller 690 may be disposed at the foremost positions of the main guide 630 and the sub guide 640, respectively.

Figure 24:
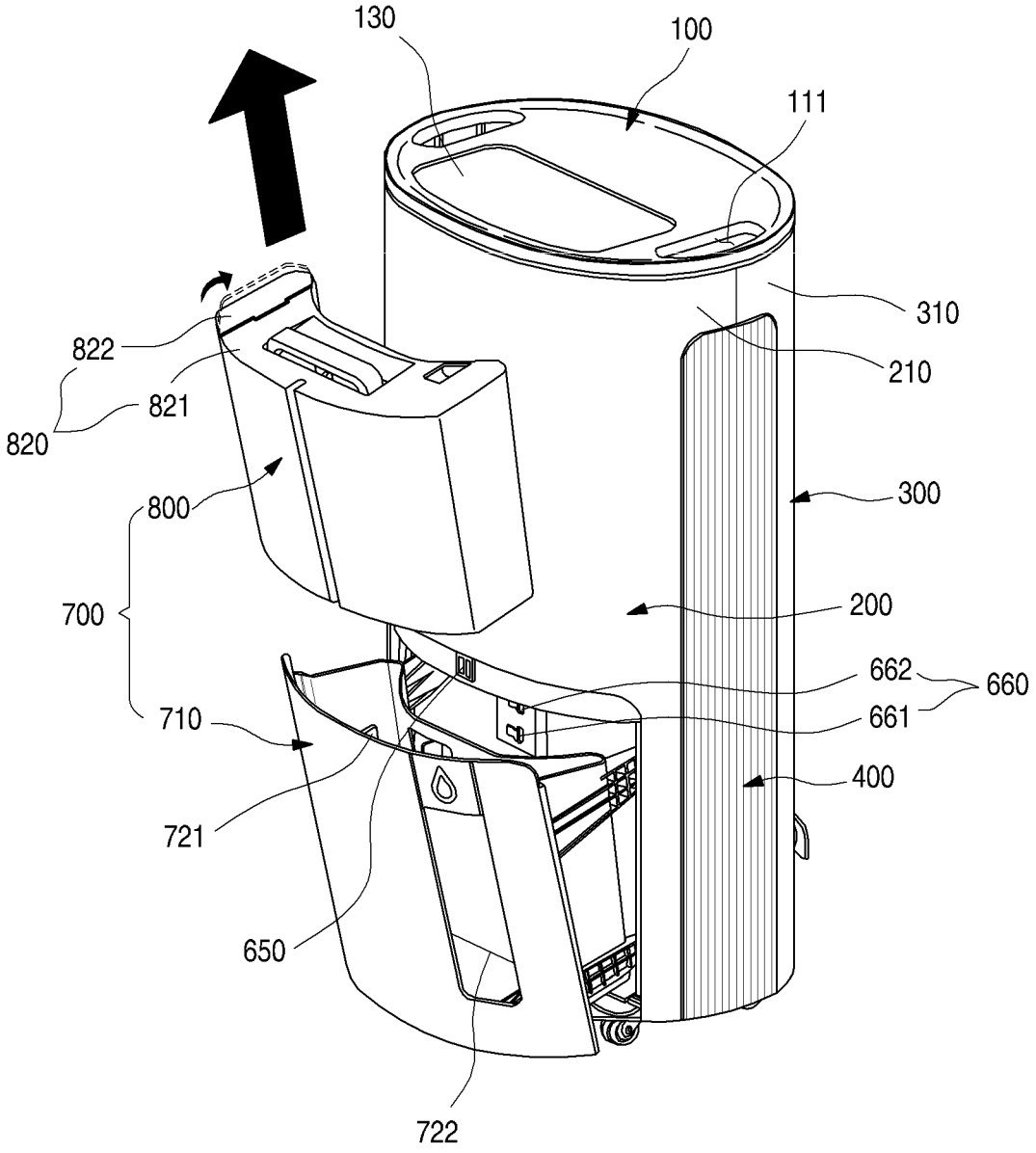
FIG. 24 is a perspective view illustrating a state in which the water tank is separated from the water tank assembly.

FIG. 24 is a perspective view illustrating a state in which the water tank is separated from the water tank assembly. When the tank drawer 710 is completely tilted, the water tank 800 may be withdrawn from the accommodation part 730. Then, the water tank 800 may be separated from the accommodation part 730, and the opening part 822 of the water tank 800 may rotate to discard the water within the water tank 800. To easily separate and move the water tank 800, the tank handle 840 may be withdrawn upward. Thus, the user may separate or move the water tank 800 while grasping the tank handle 840.

In the dehumidifier according to the embodiment, the handle that is recessed from the top surface of the main body of the dehumidifier may be provided to allow the user to easily move the dehumidifier. Particularly, even though the dehumidifier is heavy or has a high height, the dehumidifier may stably move.

The structure of the handle may act together with the wheel disposed on the bottom surface to more easily move the dehumidifier.

Also, since the handle has the recessed top surface, and the recessed portion is opened toward the left and right sides of the main body, the user may smoothly grasp the opened portion. Thus, the handle that does not protrude to the outside may be provided by using the external component of the dehumidifier to more improve the outer appearance of the dehumidifier.

In addition, since the handle is formed by coupling the members defining the outer appearance to each other, the manufacturing costs and the number of processes may be reduced.

Embodiments provide a dehumidifier in which a handle that is recessed inward from a top surface of a main body to open both side surfaces thereof is disposed to stably move the main body of the dehumidifier without deteriorating an outer appearance of the dehumidifier.

In one embodiment, a dehumidifier includes: a top cover assembly defining a top surface of a main body; a handle hole opened at each of both left and right sides of the top cover assembly; and a side deco coupled to the top cover assembly to define at least a portion of each of both left and right surfaces of the main body, wherein a handle connected to the handle hole and having an opening that is opened through a side surface of the main body to allow a user to grasp the handle is disposed on an upper end of the side deco.

The side deco may include: a deco member defining an outer appearance of each of both side surfaces of the main body; and a handle member coupled to the deco member to define the opening.

Both ends of the handle member may be coupled to both ends of each of the deco members, and the rest portions of the handle member except for both ends of the handle member may be spaced apart from the deco member.

A round part that contacts a hand of the user and is rounded with a predetermined curvature may be disposed on an inner side surface of the handle member.

The handle member may be covered by a front case and rear case which define outer appearances of front and rear surfaces of the main body.

A handle support supporting the front and rear cases may be further disposed on the handle member.

A handle fixing part protruding so that a screw coupled to the top cover assembly passes therethrough may be further disposed on an outer surface of the handle member.

Upper portions of the pair of deco members disposed on both left and right sides may be gradually closer to each other upward.

A frame supporting a heat exchange module that is heat-exchanged with suctioned air may be disposed inside the main body, and a seating rib protruding and seated on the frame may be further disposed on a back surface of the side deco.

A lower end of the handle hole and an upper end of the side deco may be stepped to match each other.

The side deco may be disposed between the front and rear cases that define outer appearances of front and rear surfaces of the main body to define an outer appearance of each of both side surfaces of the main body.

The side deco may contact and support a bottom surface of the top cover assembly and front and rear cases that define outer appearances of front and rear surfaces of the main body.

The side deco may be disposed between front and rear cases that define outer appearances of front and rear surfaces of the main body, and an upper portion of the side deco defining the handle may be covered by front and rear extension parts that respectively extend from the front and rear cases.

In another embodiment, a dehumidifier includes: a main body in which a compressor, a heat exchange module, and a fan are accommodated; a top cover assembly disposed on a top surface of the main body, the top cover assembly having a handle hole of which both left and right sides are opened; a side deco disposed on each of both left and right surfaces of the main body, the side deco having an upper portion that is rounded toward the handle hole; front and rear cases respectively disposed on both sides of the side deco to define front and rear surfaces of the main body; and front and rear extension parts respectively extending from upper ends of the front and rear cases, the front and rear extension parts being connected to each other to cover the upper portion of the side deco, wherein the handle hole, the upper end of the side deco, and the front and rear extension parts are coupled to each other to define a handle to be grasped by a user.

In further another embodiment, a dehumidifier includes: a main body including a heat exchange module, a compressor supplying a high-temperature high-pressure compression refrigerant to the heat exchange module, and a fan motor forcibly blowing air passing through the heat exchange module; a cover plate defining a top surface of the main body; and a handle is defined by connecting an opening of each of both left and right surfaces of the cover plate to an opening of an upper portion of each of both left and right surfaces of the main body and is grasped by a user to move the main body.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier comprising:

a main body in which a compressor, a heat exchange module, and a fan are accommodated;

a top cover assembly provided on a top surface of the main body;

a first handle hole provided within a left side of a top surface of the top cover assembly and a second handle hole provided within a right side of the top surface of the top cover assembly, the first and second handle holes being holes that passes completely through the top surface of the top cover assembly so as to create spaces for respective first and second handles on side ends of the top surface of the top cover assembly;

a first side deco provided on a left surface of the main body and a second side deco provided on a right surface of the main body, the first and second side decos each having an upper portion that is rounded toward the first and second handle holes and an upper edge that connects with edges of the first and second handle holes, respectively, at the top cover assembly;

front and rear cases respectively provided on both sides of the first and second side decos to define front and rear surfaces of the main body; and front and rear extension parts respectively extending from upper ends of the front and rear cases, the front and rear extension parts being connected to each other to cover the upper portion of the first and second side decos, wherein the first and second handle holes, upper ends of the first and second side decos, and the front and rear extension parts are coupled to each other to define the first and second handles.

2. The dehumidifier according to claim 1, wherein a round part that contacts a hand of a user and is rounded with a predetermined curvature is provided on an inner side surface of the first handle.

3. The dehumidifier according to claim 1, wherein a handle support that supports the front and rear cases is further provided on the first handle.

4. The dehumidifier according to claim 1, wherein a handle fixing part protrudes so that a screw coupled to the top cover assembly passes therethrough is further provided on an outer surface of the first handle.

5. The dehumidifier according to claim 1, wherein a frame that supports the heat exchange module is provided inside the main body, and a seating rib protruding from and seated on the frame is further provided on a back surface of the first side deco.

6. The dehumidifier according to claim 1, wherein a lower end of the first handle hole and an upper end of the first side deco are stepped to match each other.

* * * * *